US006074040A

United States Patent [19]

Usui et al.

[11] Patent Number: 6,074,040

[45] Date of Patent: Jun. 13, 2000

[54] INK JET PRINTER HEAD, ITS MANUFACTURING METHOD AND INK

[75] Inventors: Takahiro Usui; Hitoshi Fukushima; Satoru Miyashita, all of Nagano-ken, Japan

[73] Assignee: Seiko Epson Corporation, Tokyo, Japan

[21] Appl. No.: 08/894,927

[22] PCT Filed: Jan. 17, 1997

[86] PCT No.: PCT/JP97/00088

§ 371 Date: Sep. 3, 1997

§ 102(e) Date: Sep. 3, 1997

[87] PCT Pub. No.: WO97/27059

PCT Pub. Date: Jul. 31, 1997

[30] Foreign Application Priority Data

| | | | |
|---|---|---|---|
| Jan. 23, 1996 | [JP] | Japan | 8-009282 |
| Nov. 13, 1996 | [JP] | Japan | 8-302218 |
| Dec. 2, 1996 | [JP] | Japan | 8-322033 |

[51] Int. Cl.[7] ..... B41J 2/135

[52] U.S. Cl. ..... 347/45; 347/47

[58] Field of Search ..... 347/45, 47, 68, 347/70, 71, 100; 427/430.1

[56] References Cited

U.S. PATENT DOCUMENTS

| | | | |
|---|---|---|---|
| 4,368,476 | 1/1983 | Uehara et al. | 347/45 |
| 5,119,116 | 6/1992 | Yu | 347/45 X |
| 5,378,504 | 1/1995 | Bayard et al. | 347/45 X |
| 5,863,371 | 1/1999 | Takemoto et al. | 347/45 X |

FOREIGN PATENT DOCUMENTS

| | | |
|---|---|---|
| 5-23645 | 2/1993 | Japan . |
| 5-116325 | 5/1993 | Japan . |
| 6-191033 | 7/1994 | Japan . |
| 6-322595 | 11/1994 | Japan . |
| 7-246707 | 9/1995 | Japan . |

*Primary Examiner*—William Royer
*Assistant Examiner*—Hoan Tran
*Attorney, Agent, or Firm*—Sughrue, Mion, Zinn, Macpeak & Seas, PLLC

[57] ABSTRACT

In an ink jet printer head which ejects ink drops from a nozzle (11) formed on the surface of the nozzle plate (1), wherein a metal layer (13) and a sulfur compound layer (14) are formed on the surface of the nozzle. Gold atoms of the metal layer (13) and sulfur atoms of the sulfur compound layer (14) are bonded covalently and form a water repellant thin film.

Since ink does not remain on the nozzle surface, problems such as ink drops being pulled by residue ink and the ejection direction of ink drops being bent are eliminated.

27 Claims, 12 Drawing Sheets

INK JET PRINTER HEAD, ITS MANUFACTURING METHOD AND INK

BACKGROUND OF THE INVENTION

The present invention relates to an ink jet printer head. In particular, the present invention relates to an improvement of a nozzle surface of the ink jet printer head which selectively attaches ink drops to a recording medium.

High speed printing, low noise and high print quality are being demanded of ink jet printers. Also high performance capability is demanded of an ink jet printer head. In order to satisfy these demands, conditions of the nozzle surface of the ink jet printer head plays an important role.

Often, ink, paper dust and the like attaches on the nozzle surface. When such attachments are present on the nozzle surface, the ink drops which are being ejected out of the nozzle are attracted to these attachments and the ink drops are ejected in a direction that is different from the original ejection direction. If the amount of such attachments is large, the proper ink drops are not formed. In order to resolve these problems, it has been considered important to provide ink repellant properties (e.g., water repellant property) to the nozzle surface. By providing ink repellant properties to the nozzle surface, attachment of ink and paper dust may be reduced. Methods in which silicon type compounds or fluoride type compounds are formed on the nozzle surface have been suggested as a technique to provide such ink repellant properties.

However, the nozzle surface on which silicon compounds and the like are formed has presented a problem in that the nozzle surface has poor resistance against various inks. The silicon type compound has a siloxane bond (Si—O) as part of its basic structure. The siloxane bond is easily cleaved by a base. Hence, the resistance of the nozzle surface has been weak against the inks containing alkaline components. In other words, the ink used for an ink jet printer contains water in which many components such as dye, solvent and surfactant are added. A dye is a salt made of acid and alkaline. The salt is ionized in the water and forms a base (ammonium ion, sodium ion, calcium ion and the like). Moreover, in order to improve penetration of the solvent into the paper, a solvent with high level of chemical activity such as one that melts the paper fiber is used. Such solvents naturally also have the function of decomposing the silicon compounds.

Moreover, the adhesive power of fluorine compounds with the nozzle surface is small. Hence, this created a problem such that compounds are easily peeled off from the nozzle surface by the cleaning operation (hereafter wiping) of the print head to wipe off the ink, paper dust and the like that are attached on the nozzle surface. There has been no simple method to reprocess the nozzle surface once the ink repellant film is removed from the nozzle surface. Hence, even if other parts of the ink jet printer head is operating normally, the entire ink jet printer head has to be replaced.

A first object of the present invention is to provide an ink jet printer head with water repellant property without substantial deterioration of its ink drop ejection capability, and to provide a method of making such an ink jet printer head.

A second object of the present invention is to provide an ink jet printer head which substantially maintains its water repellant property caused by wear of the nozzle surface, and to provide an ink for use therein.

SUMMARY OF THE INVENTION

A first embodiment of the invention achieves the first object. In other words, the first embodiment is an ink jet printer head, wherein ink drops are ejected from the nozzle being formed on the nozzle surface, wherein a water repellant layer comprising a metal layer containing metal is formed on said nozzle surface, and wherein a sulfur compound layer containing sulfur compounds is formed on said metal layer.

A second embodiment invention achieves the first object. In other words, the second embodiment is an ink jet printer head of claim 1 wherein said water repellant layer comprises an intermediate layer consisting of nickel, chrome, tantaline, or titanium, or an alloy made of these metals between the member forming said nozzle surface and said metal layer.

A third embodiment of the invention achieves the second object. In other words, the third embodiment is an ink jet printer head of claim 1 or claim 2 wherein said water repellant layer is formed on the inner wall of said nozzle.

A fourth embodiment of the invention achieves the second object. In other words, the fourth embodiment is an ink jet printer head of claim 1 or claim 2 wherein said nozzle is provided inside indentation section of said nozzle surface.

A fifth embodiment of the invention achieves the first object. In other words, the fifth embodiment is an ink jet printer head of claim 1 or claim 2 comprising a cavity for filling the ink and a pressure apparatus for causing a volume change in said cavity, wherein ink drops are made to be ejected out of said nozzle by the volume change of said cavity.

A sixth embodiment of the invention achieves the first object. In other words, the sixth embodiment is an ink jet printer head of claim 5 wherein said pressure apparatus is made of a piezoelectric element.

A seventh embodiment of the invention achieves the first object. In other words, the seventh embodiment is an ink jet printer head of claim 5 wherein said pressure apparatus is made of a heat generating element.

An eighth embodiment of the invention achieves the first object. In other words, the eighth embodiment is an ink jet printer head wherein said sulfur compounds are thiol compounds.

A ninth embodiment of the invention achieves the first object. In other words, the ninth embodiment is an ink jet printer head of claim 8 wherein said thiol compounds have the following structure:

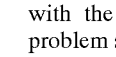

R—S—H (R represents a hydrocarbon radical)

A tenth embodiment of the invention achieves the first object. In other words, the tenth embodiment is an ink jet printer head of claim 8 wherein R of said thiol compounds has the following structure:

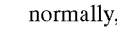

$C_nH_{2n+1}$—

An eleventh embodiment of the invention achieves the first object. In other words, the eleventh embodiment is an ink jet printer head of claim 8 wherein R of said thiol compounds has the following structure:

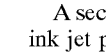

$C_nF_{2n+1}$—

A twelfth embodiment of the invention achieves the first object. In other words, the twelfth embodiment is an ink jet printer head of claim 8 wherein R of said thiol compounds has the following structure:

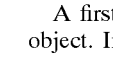

$C_nF_{2n+1}$—$C_mH_{2m}$—

A thirteenth embodiment of the invention achieves the first object. In other words, the thirteenth embodiment is an ink jet printer head of claim 1 wherein said sulfur compounds comprise a mixture of the following two types of thiol molecules:

R1—SH, R2—SH (R1 and R2 are mutually exclusive chemical structures).

A fourteenth embodiment of the invention achieves the first object. In other words, the fourteenth embodiment is an ink jet printer head of claim 1 wherein said sulfur compounds comprise the following chemical formula:

HS—R3—SH.

A fifteenth embodiment of the invention achieves the first object. In other words, the fifteenth embodiment is an ink jet printer head of claim 1 wherein said sulfur compounds comprise the following chemical formula:

R4—S—S—R4

A sixteenth embodiment of the invention achieves the first object. In other words, the sixteenth embodiment is an ink jet printer head of claim 13 wherein R1 and/or R2 of said thiol compounds comprise the following chemical formula:

CnF2n+1—

A seventeenth embodiment of the invention achieves the first object. In other words, the seventeenth embodiment is an ink jet printer head of claim 13 wherein R1 and/or R2 of said thiol compounds comprise the following chemical formula:

CnF2n+1-CmH2m—

An eighteenth embodiment of the invention achieves the first object. In other words, the eighteenth embodiment is an ink jet printer head of claim 14 wherein R3 of said thiol compounds comprise the following chemical formula:

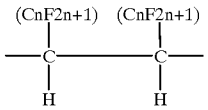

A nineteenth invention achieves the first purpose. In other words, the nineteenth invention is an ink jet printer head of claim 14 wherein R3 of said thiol compounds comprise the following chemical formula:

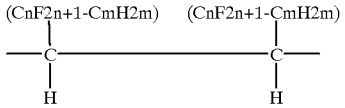

A twentieth embodiment of the invention achieves the first object. In other words, the twentieth embodiment is an ink jet printer head of claim 14 wherein R3 of said thiol compounds comprise the following chemical formula:

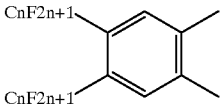

A twenty-first embodiment of the invention achieves the first object. In other words, the twenty-first embodiment is an ink jet printer head of claim 14 wherein R3 of said thiol compounds comprise the following chemical formula:

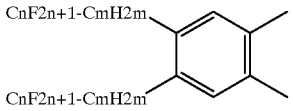

A twenty-second embodiment of the invention achieves the first object. In other words, the twenty-second embodiment is an ink jet printer head of claim 15 wherein R4 of said thiol compounds comprise the following chemical formula:

CnF2n+1—CmH2m—

A twenty-third embodiment of the invention achieves the first object. In other words, the twenty-third embodiment is an ink jet printer head of claim 15 wherein R4 of said thiol compounds comprise the following chemical formula:

CnF2n+1—

A twenty-fourth embodiment of the invention achieves the first object. In other words, the twenty-fourth embodiment is an ink jet printer head wherein the nozzle member of claim 1 and claim 2 is made of silicon or ceramics.

A twenty-fifth embodiment of the invention achieves the first object. In other words, the twenty-fifth embodiment is a production method of an ink jet printer head comprising a step to form a metal layer on the nozzle surface of the nozzle element and a step to immerse the material which forms said metal layer in a solution in which sulfur compounds are dissolved.

A twenty-sixth embodiment of the invention achieves the second object. In other words, the twenty-sixth embodiment is an ink, of the type of ink used in the ink jet printer head of claim 1 or claim 2, containing sulfur compounds.

A twenty-seventh embodiment of the invention achieves the first object. In other words, the sulfur compounds of claim 1 use a material whose static water contact angle on the surface of said sulfur compound layer is more than about 100°.

DETAILED DESCRIPTION OF PREFERRED EMBODIMENTS

Hereafter, most preferred embodiments of the present invention will be described in reference to drawings.

Configuration of First Embodiment

Figure 1:
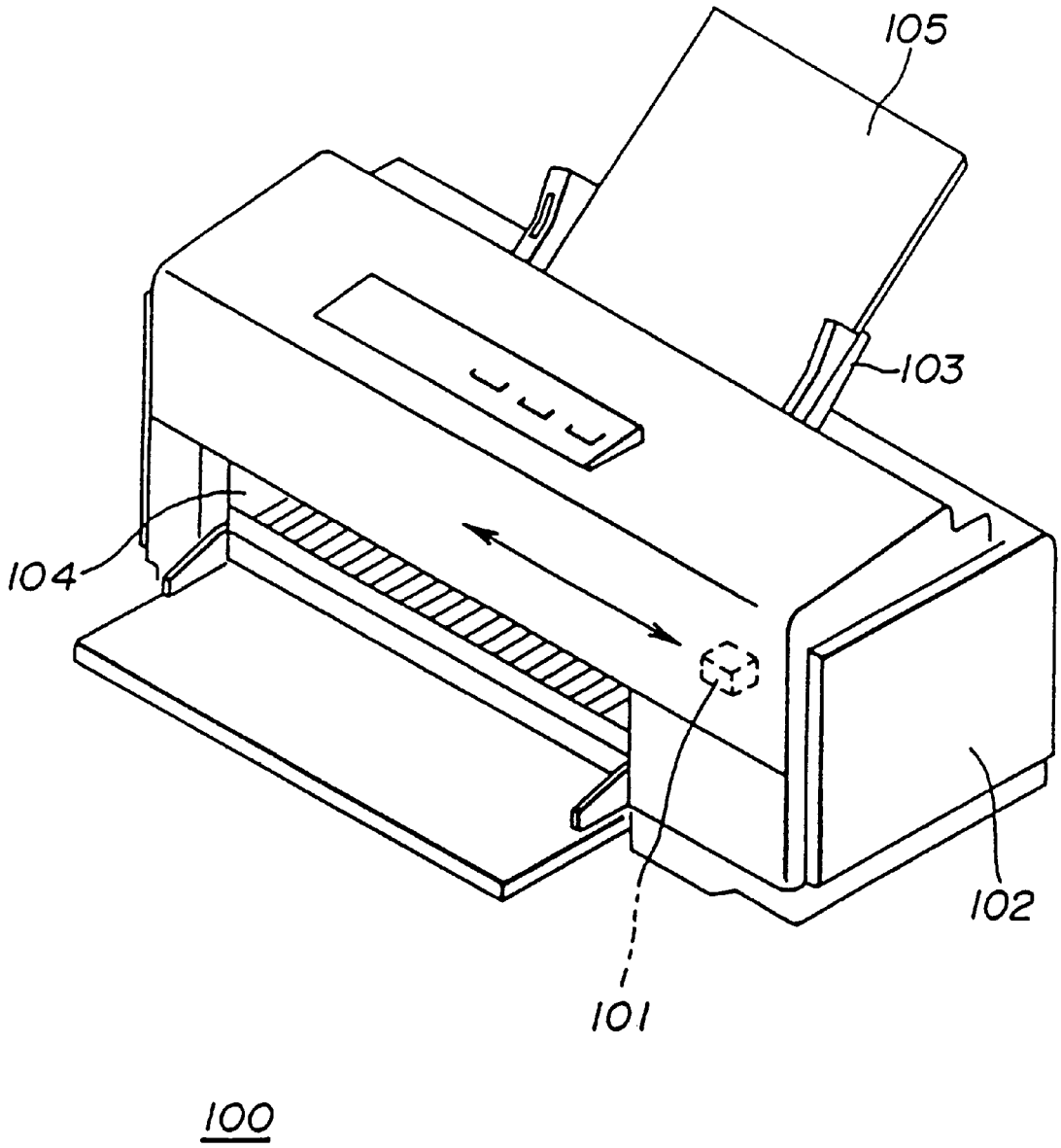
FIG. 1: An overall perspective diagram of an ink jet printer.

FIG. 1 is a perspective diagram of a printer in which an ink jet printer head of the present embodiment is used. As the figure indicates, the ink jet printer 100 of the present embodiment is structured in such a manner that a main body 102 comprises the ink jet printer head 101, a tray 103 and the like which relate to the present invention. Papers 105 are loaded in a tray 103. When the print data are supplied from a computer (not shown), a inner roller (not shown) takes in the paper 105 into the main body 102. The papers 105, when passing the vicinity of the roller, are printed by an ink jet printer head 101 which is driven in the direction of the arrow in the figure and is discharged from an discharge opening 104. If the ink drops are not ejected accurately from the ink jet printer head 101, letters and the like which are printed on the papers 105 are smeared or are too light.

Figure 2:
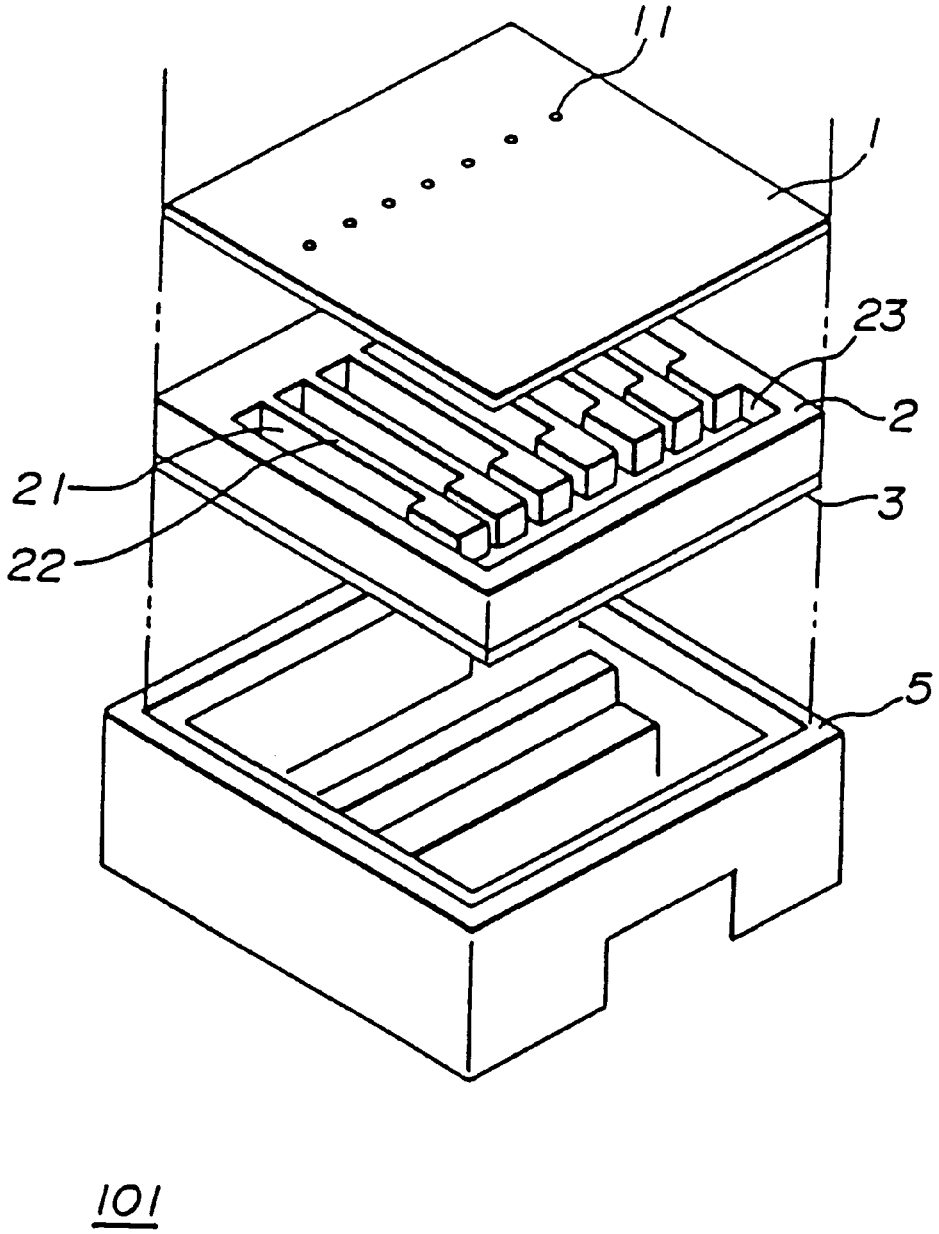
FIG. 2: A perspective diagram describing a structure of an ink jet printer head.

FIG. 2 is a perspective diagram depicting a structure of the ink jet printer head of the present embodiment. As described in the figure, the ink jet printer head 101 comprises a nozzle plate 1 on which nozzles 11 are provided and a flow path board 2 on which a vibration plate 3 is provided with both plates being fitted in the case 5. The flow path board 2 is also called a pressure chamber board and a cavity (pressure chamber) 21, a side wall 22, a reservoir 23 and the like are formed in it. The characteristics of the present invention relate to processing of the surface of nozzle plate of the ink jet printer head.

Moreover, in the present embodiment, a reservoir for holding ink is provided on the flow path board but the nozzle plate may be a multi-layer structure and the reservoir may be provided inside of the nozzle plate structure.

Figure 3:
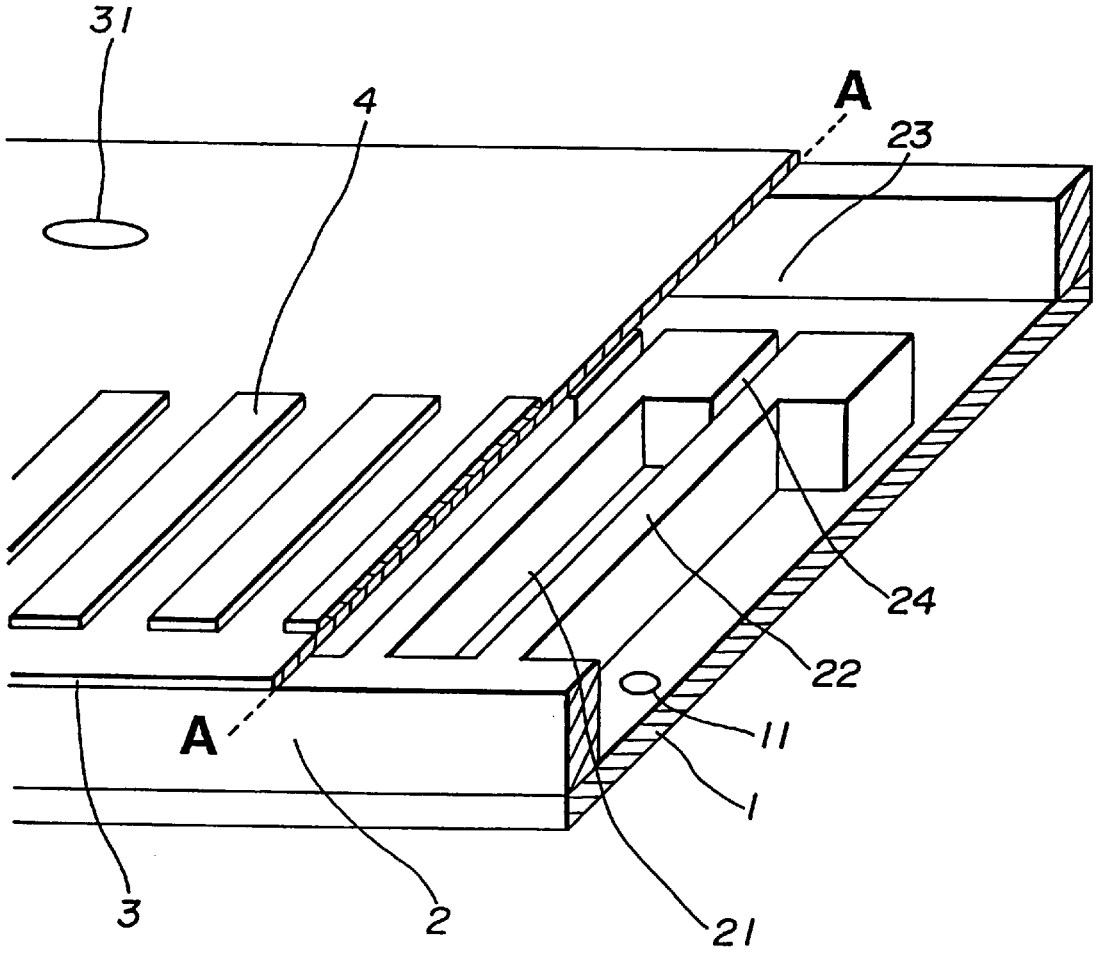
FIG. 3: A perspective view of a major part (sectional cross section) of an ink jet printer head.

FIG. 3 is a perspective diagram depicting a major section of the ink jet printer head which is composed of laminating the flow path board 2 and the vibration plate 3 on the nozzle plate. For ease of understanding, a partial cross section is presented. As described by the figure, the main unit of the ink jet printer head is structured in such a manner that the flow path board 2 is fitted with the nozzle plate 1 and the vibration plate 3. By etching silicon single crystal boards and the like, a plurality of cavities 21, each of which functions as pressure chamber, are provided on the flow path board 2. Each cavity 21 is separated by the side wall 22. Each cavity 21 is connected to the reservoir 23 through a supply opening 24. The nozzle 11 is provided in the nozzle plate 1 at the location corresponding to the cavity 21 of the flow path board 2. For example, the vibration plate 3 is made of a heat oxidation film. A piezoelectric element 4 is formed at the location corresponding to the cavity 21 on the vibration plate 3. Moreover, an ink tank opening 31 is provided in the vibration plate 3. The piezoelectric element 4 is structured in such a manner that a PZT element and the like is pinched by the upper electrode and the lower electrode (not shown). The following explanation will be based on the cross section of the ink jet printer head with respect to the line A—A in FIG. 3.

Figure 4:
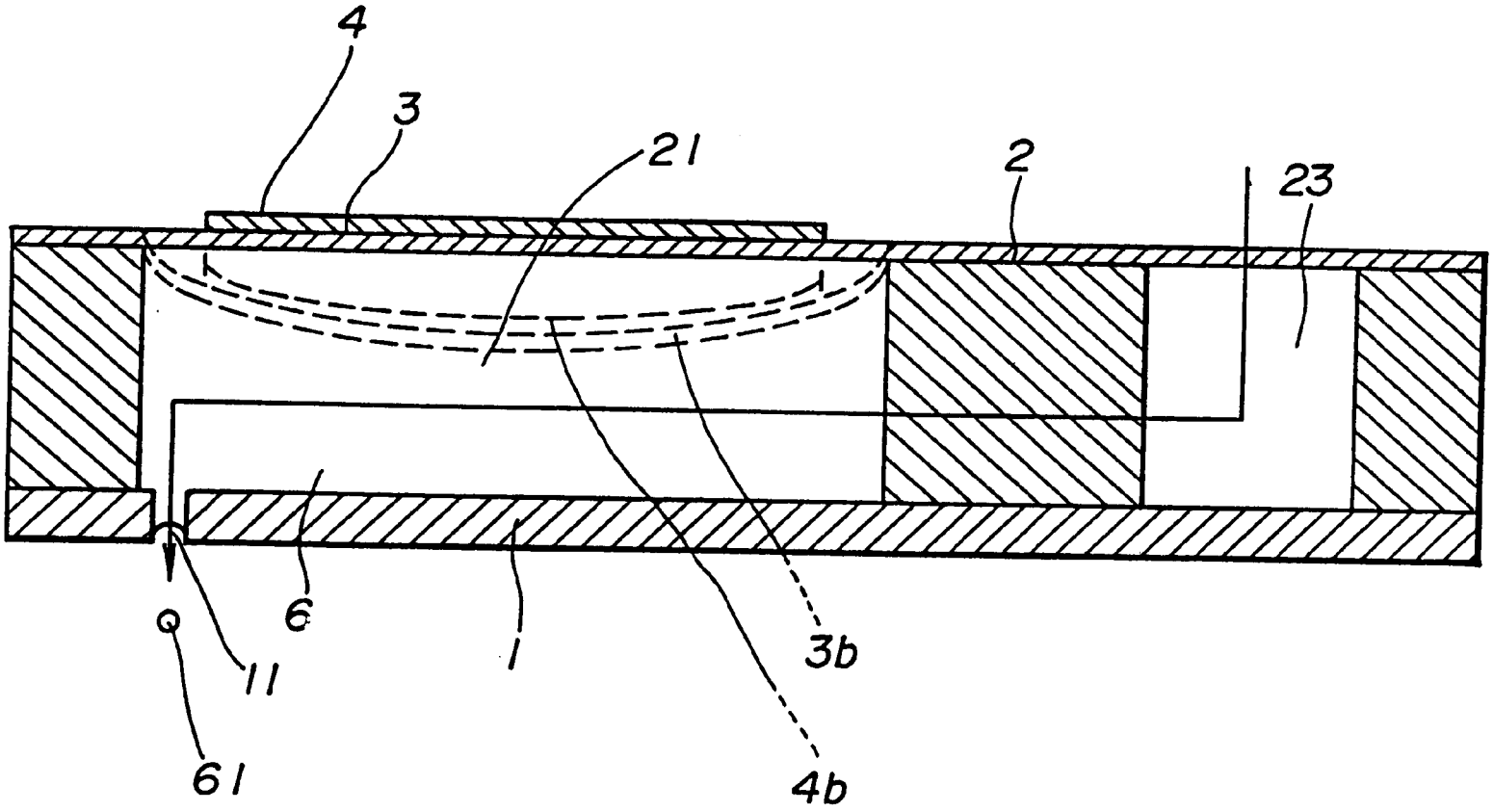
FIG. 4: A cross-sectional diagram conceptually depicting operation of an ink jet printer head.

Operation principle of the ink jet printer head will be described with reference to FIG. 4. The ink is supplied from the ink tank in the case 5 into the reservoir 23 through the ink tank opening which is provided in the vibration plate 3. The ink flows into each cavity 21, from the reservoir 23 through the supply opening 24. The volume of piezoelectric element 4 changes when voltage is applied between the upper electrode and the lower electrode. This volume change deforms the vibration plate 3, which in turn changes the volume of the cavity 21. The vibration plate 3 does not deform unless the voltage is applied. However, upon application of the voltage, the vibration plate 3 deforms to the position of the post deformation vibration plate 3*b*, or post deformation piezoelectric element 4*b*, which are described by broken lines in the figure. When the volume within the cavity 21 changes, the pressure of the ink 6 being filled in the cavity rises, causing ink drop 61 to be ejected out of nozzle 11.

Figure 5:
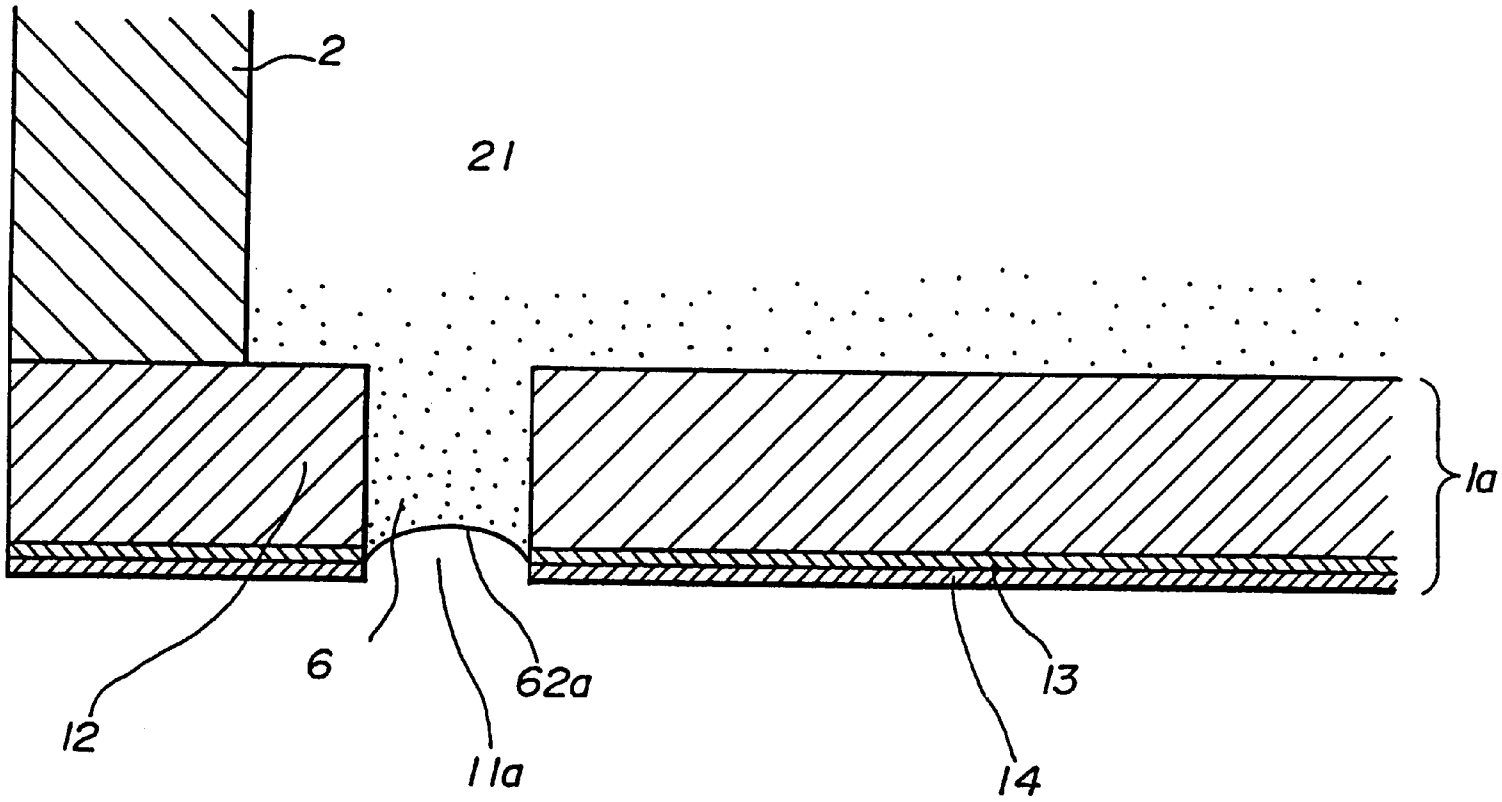
FIG. 5: A cross section of a nozzle plate in a first embodiment.

FIG. 5 is a cross section depicting layer structure of the nozzle plate in the present embodiment. The figure is an enlarged cross section of the vicinity of the nozzle of FIG. 3 and FIG. 4. The symbol 1*a* indicates the nozzle plate in the present embodiment. Nozzle plate 1*a* is made of laminating metal layer 13 and sulfur compound layer 14 on the ink drop ejecting side of the nozzle member 12. The same structures in FIG. 2 and FIG. 3 are identified with the same symbol. A meniscus 62*a* of ink is formed in the nozzle 11*a* due to surface tension of the ink. In other words, ink filled in the cavity 21 does not spread over the surface of nozzle plate 1*a*, but only forms the meniscus 62*a* in the nozzle 11*a*, due to ink repellent property of the sulfur compound layer 14.

The nozzle member 12 may be made of any material as long as it provides certain bonding forces between itself and the metal layer. For example, glass or metal plate may be used. However, in order to reduce manufacturing cost and to make the intricate process such as drilling the nozzle hole easier, silicon or ceramics are preferred. Here, if silicon or ceramic is used, it is preferred to provide an intermediate layer which will be explained later in the present embodiment (see FIG. 11).

For the metal layer 13, use of gold (Au) is preferred because of its chemical and physical stability. Other metals such as (Ag), copper (Cu), indium (In) and gallium-arsenic (Ga—As) which chemically adsorb sulfur compounds may also be used. Publicly known techniques such as the sputter method, evaporation method and the plating method, may be used to form metal layer 13 onto the nozzle member 12. The choice of the method is not particularly limited as long as the method is able to form a uniform thickness of the thin metal film (for example 0.1 $\mu$m).

A sulfur compound layer 14 is formed on the metal layer 13. Formation of the sulfur compound layer 14 is accomplished by dissolving sulfur compound into solution and by immersing the nozzle plate la on which the metal layer 13 is formed in the solution.

Here the sulfur compound refers to a general name of a compound, among organic containing sulfur (S), which contains one or more thiol functional groups or a compound which forms a disulfide bond (S—S bonding). These sulfur compounds spontaneously and chemically adsorb to metal surfaces such as gold in the solution or under volatile conditions and form single molecule film that is close to a two dimensional crystal structure. The molecule film created by spontaneous and chemical adsorption is called a self-gathering film, a self-organizing film or a self-assembly film. Currently, basic study and applied study of the self-gathering film is in progress. In the present embodiment, gold (Au) is used, but the self-gathering film may be formed equally on other metal surfaces that are mentioned above.

A thiol compound is preferred as a sulfur compound. The thiol compound refers to a general name for an organic compound (R—SH where R represents a hydrocarbon radical such as an alkyl group) containing a mercapto group (—SH).

Figure 6:
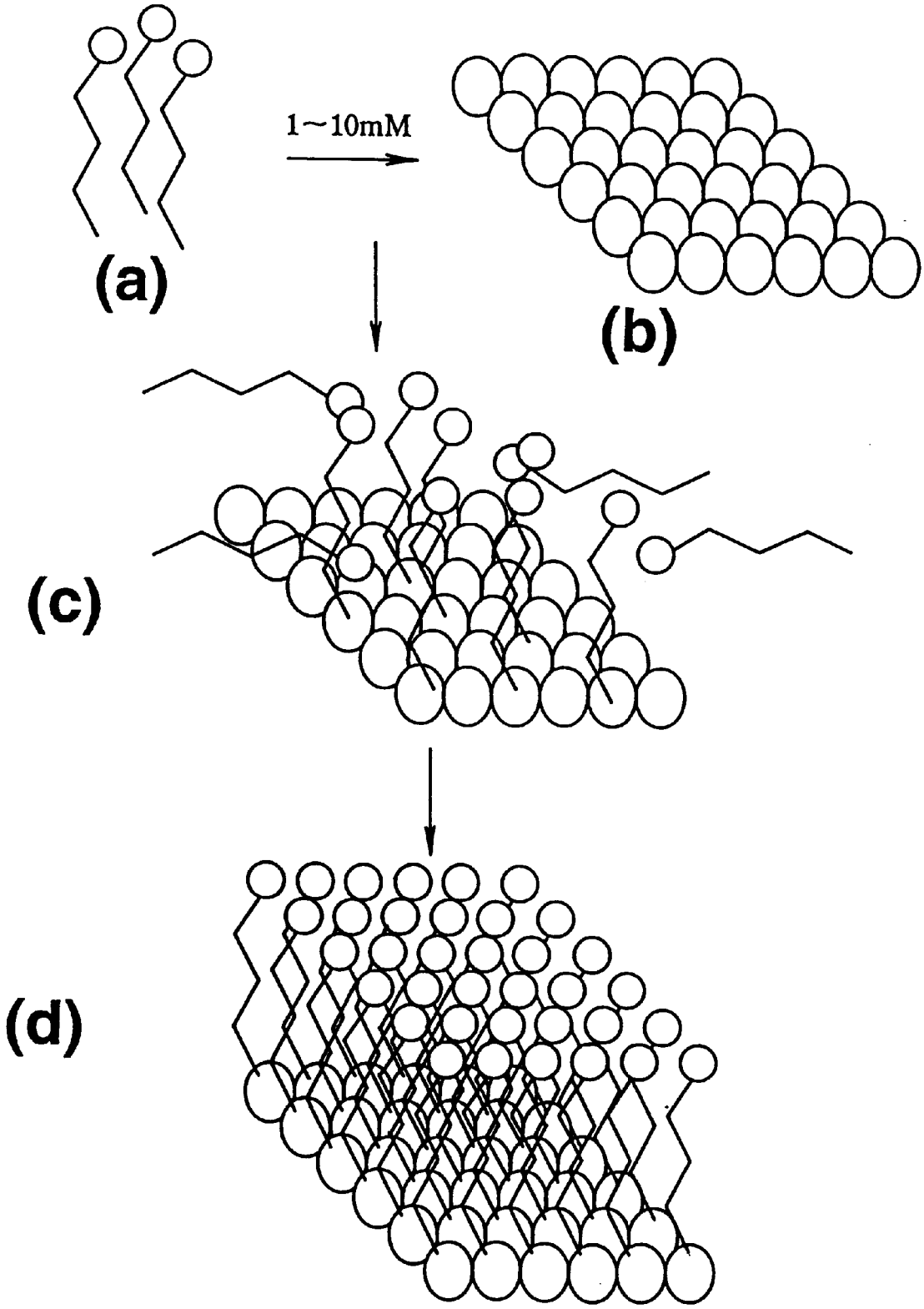
FIG. 6: A diagram depicting bonding between thiol molecules and gold.

Next, a method of sulfur compound generation is described using FIG. 6. The figure describes a case in which gold is used as a metal layer, and a thiol compound is used as a sulfur compound. The thiol compound has an alkyl group or the like for the head section and a mercapto group for the tail section as described in FIG. 6 at (*a*). The thiol compound is dissolved with 1–10 mM ethanol solution. A gold film which is created as in FIG. 6 at (*b*) is immersed in the solution. When the solution is left alone for about one hour at room temperature, thiol compounds begin to be spontaneously collected on the gold surface (FIG. 6 at (*c*)). Moreover, a two dimensional single molecule thick film of thiol molecules is formed on the gold surface (FIG. 6 at (*d*)).

Figure 7:
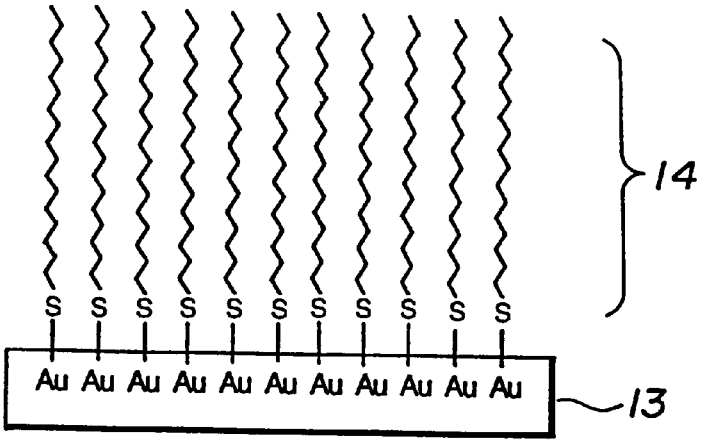
FIG. 7: A diagram depicting bonding between sulfur atoms and gold atoms.

FIG. 7 describes a condition of the bonding between molecules when the single molecule thick film of thiol compound is formed. The reaction mechanism of the chemical adsorption of sulfur atoms on the metal surface is not completely known. However, a structure in which an organic sulfur compound is adsorbed on a gold (0) surface as Au (1) thiolate (RS—Au+) may be possible. Bonding of a gold atom of metal layer 13 with a sulfur atom of a sulfur compound layer 14 is close to covalent bonding (40–45 kcal/mol) and a very stable molecule film is formed.

Incidently, solid surface functionalization techniques such as self-organization of organic molecules into films, may be applied to such field as shining, smoothing, wetting, anti-corrosion, surface catalyst function of the material surface. Moreover, application of this technology in the fields of micro-electronics such as molecular elements, bio-elements and bio-electronics has a promising future.

Figure 8:
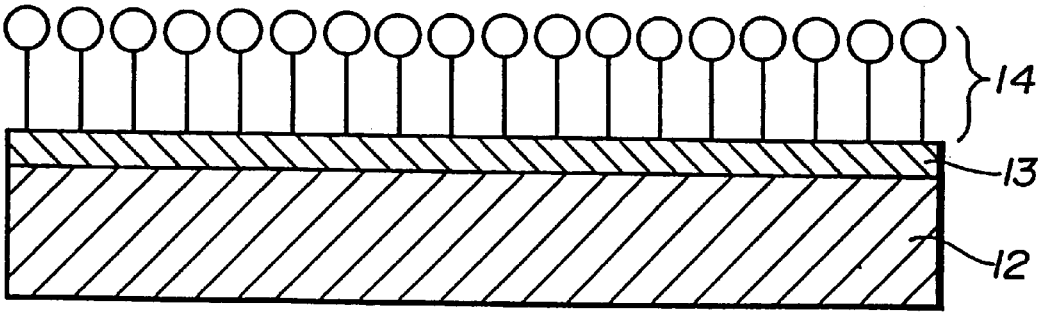
FIG. 8: A diagram depicting arrangement of thiol molecules on a gold surface.

FIG. 8 depicts a condition wherein a single molecule thick film of sulfur compounds is formed on the surface of the metal layer 13. As the figure depicts, the sulfur compound layer 14 is composed of a single molecule thick layer having a film thickness which is very thin (for example, about 2 nm). The sulfur compounds gather very tightly preventing water molecules form entering the sulfur compound layer 14. Hence, the sulfur compound layer 14 displays ink repellant (water repellant) properties.

Figure 9:
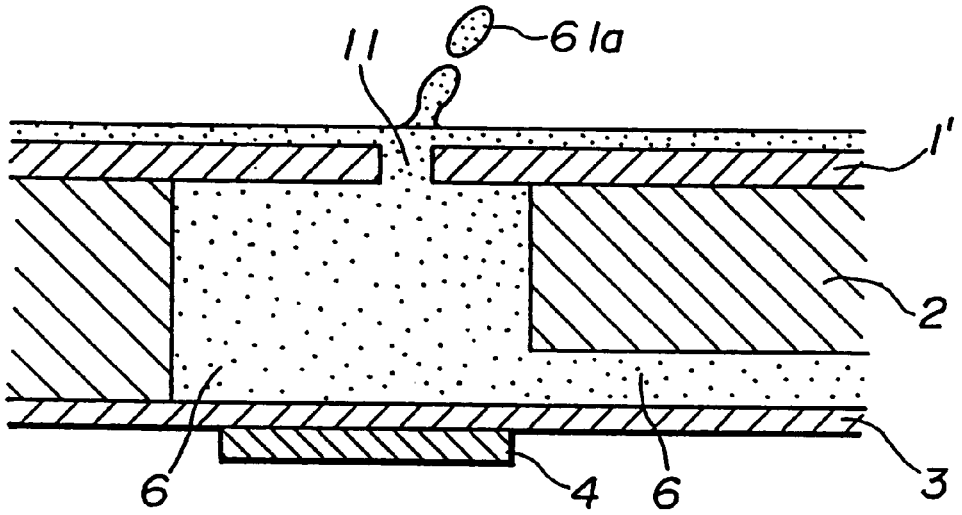
FIG. 9: A diagram depicting ejection of ink from of an ink jet printer head without ink repellant property.

In an ink jet printer head without ink repellant properties, as described in FIG. 9, ink 6 often spreads around the nozzle surface. In this case, ink drops 61*a* which are ejected are pulled in the direction parallel to the nozzle plate 1' by the tension of ink 6, and fail to be ejected perpendicular to the nozzle plate.

Figure 10:
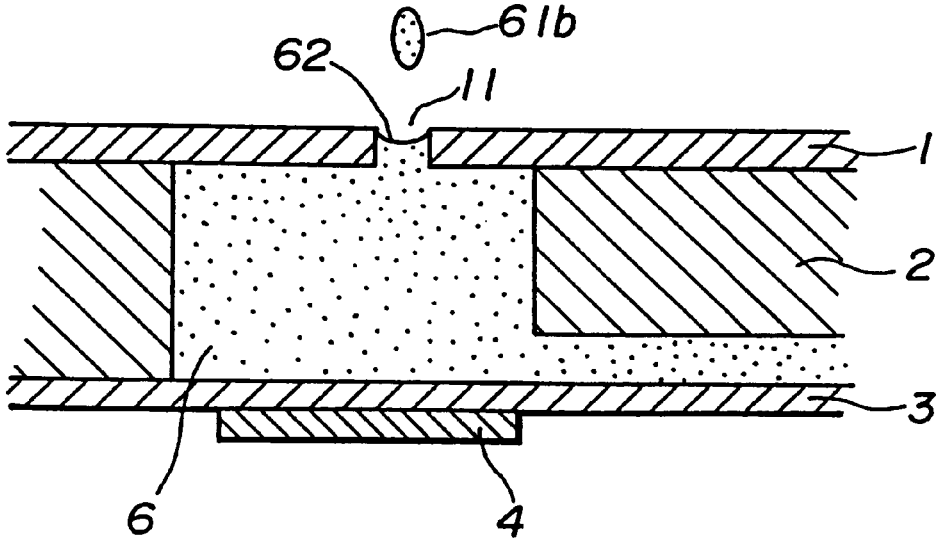
FIG. 10: A diagram depicting ejection of ink from an ink jet printer head with ink repellant property.

On the other hand, in the ink jet printer head of the present invention, the nozzle surface possesses ink repellant properties. Ink 6 is always repelled at the nozzle surface and pools inside the nozzle 11 as meniscus 62, as depicted in FIG. 10. Hence, the ink drop 61*b* is not pulled by the tension of the ink and is ejected perpendicular to the nozzle 11. Moreover, because of the ink repellant properties of the nozzle surface, the ink being ejected on the nozzle surface pools as drop rather than scattering over the nozzle surface. Hence, elimination of unnecessary ink drops may be easily accomplished by means of wiping using an elastic material such as rubber.

Formation of Intermediate Layer

Figure 11:
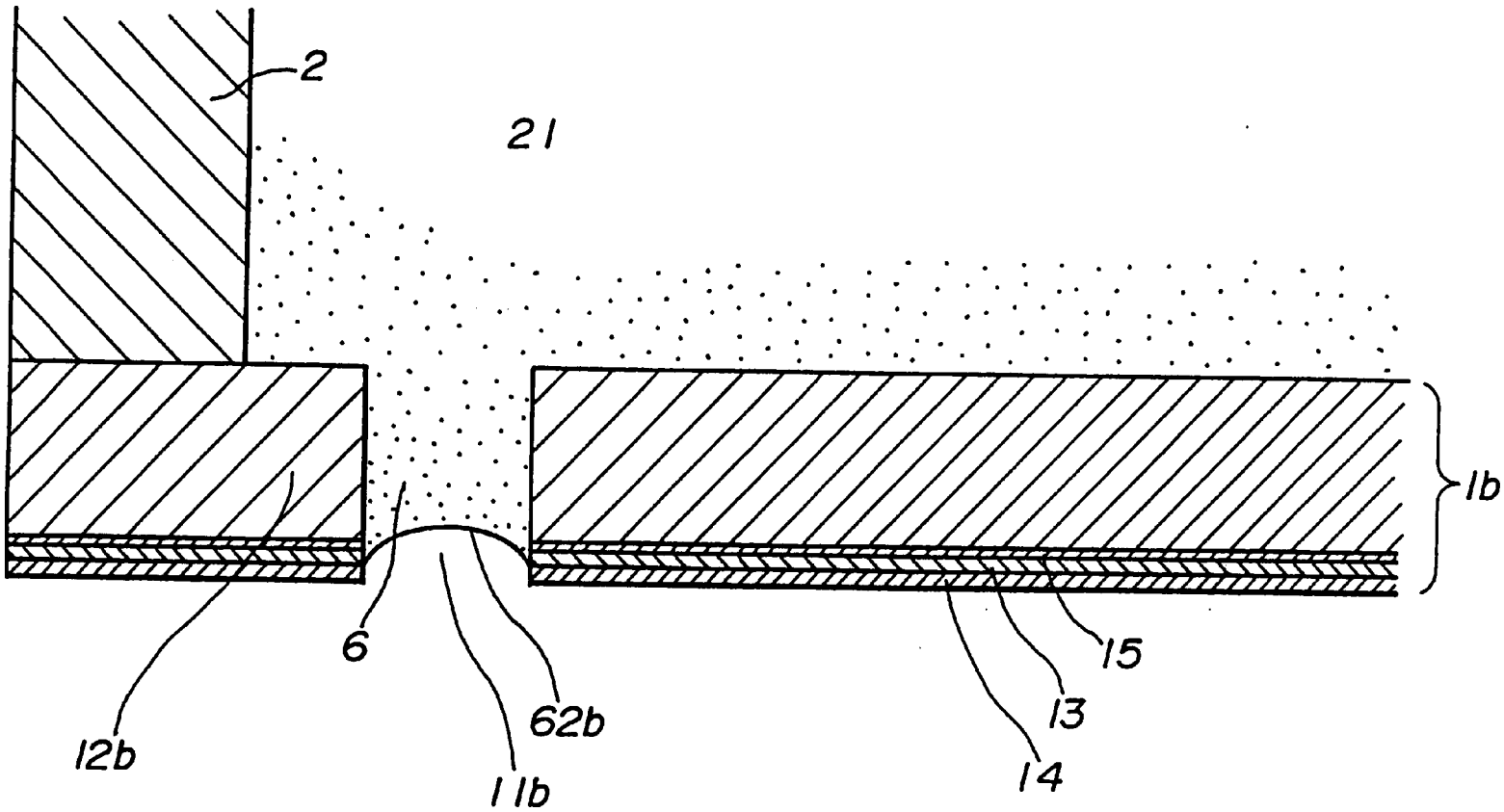
FIG. 11: A cross section of a nozzle plate for which an intermediate layer is provided in the first embodiment.

FIG. 11 depicts a cross section of a layer structure of the nozzle plate for which an intermediate layer is provided. As described above, when silicon or ceramics are used for a nozzle member which is a basic material, the bonding force is strengthened by providing an intermediate layer between the nozzle member and the metal film. The same members in FIG. 11 as in FIG. 10 are identified by the same symbols and the explanation of these members are omitted.

The nozzle member 12*b* is made of silicon or ceramics.

The intermediate layer 15 is preferably made of a material which strengthen bonding forces between the nozzle member and the metal film such as nickel (Ni), chrome (Cr), tantaline, or an alloy made of these metals. By providing an intermediate layer, the bonding force between the nozzle member and the metal layer increases and the separation of the sulfur compound layer by mechanical frictional forces becomes difficult. (Ink)

The ink 6 used for the ink jet printer head is preferably mixed with aforementioned sulfur compounds. By mixing sulfur compounds, even when part of the sulfur compounds layer is damaged due to physical impact and the like, the sulfur compounds bond again at the location of damage on the surface of the metal layer. In short, a self-restoration function is provided.

Ink repellant processes with such self-restoration properties eliminate special restoration operations otherwise required of users. In such a case, formation of a metal layer with gold as depicted in the present embodiments is preferred. Gold has superior malleability and gold material is seldom lost even if it is damaged. Moreover, gold has superior anti-chemical properties, which improve anti-chemical properties of the nozzle member.

Next, a preferred configuration of the embodiment of the ink jet printer head production method of the present embodiment will be described.

(1) Embodiment 1

In the present embodiment, an alkyl group CnH2n+1–(n=18) was used as a hydrocarbon group R in the thiol compound (R—SH).

(a) A gold film of thickness 0.5 $\mu$m was formed using a sputter method on a stainless steel nozzle plate on which a nozzle was formed.

(b) C18H37SH was dissolved in ethyl alcohol to produce 1 mM solution.

(c) The nozzle plate on which the gold layer was formed was immersed in the 1 mM ethyl alcohol solution in which C18H37SH was dissolved for 10 minutes at 25° C.

(d) The nozzle plate was then removed and rinsed with ethyl alcohol.

(e) The nozzle plate was then dried.

Ink Repellant Property

Contact angle with the ink was measured as an evaluation of the ink repellant property. Two types of ink, ink A and ink B, having different surface tension were used for evaluation. The surface tension of ink A was 35 dyn/cm and the surface tension of ink B was 19 dyn/cm. The contact angle of ink A was found to be 90° and the contact angle of ink B was found to be 60°.

Adhesive Property

As an evaluation of adhesive property, the nozzle plate surface was rubbed 5000 times with chloroprene rubber of rubber hardness 60° and with additional load of 100 g/cm, after which the contact angles of the ink relative to the nozzle were measured. As a result, all the initial contact angles were preserved and no separated section was observed.

Anti-ink Property

As an evaluation of anti-ink properties, the nozzle plate on which thiol compounds were formed was immersed in the ink for 6 days under ambient atmospheric pressure and a temperature of 60° C., after which the contact angles were measured. As a result, all the initial contact angles were preserved and no separated section was observed.

On Site Test

An ink jet printer head depicted in FIG. 10 was constructed using a nozzle plate on which thiol compounds were formed. The ink jet printer head was driven continuously 100,000 times with the response frequency of 10 KHz. As a result, all the ink drop's were ejected in a normal direction and no abnormality such as bend in the ejection direction was found.

(2) Embodiment 2

In the present embodiment, silicon was used as a silicon member and an alkyl group CnH2n+1—(n=18) was used as hydrocarbon group R in the thiol compound (R—SH). Moreover, an intermediate layer was formed with Cr in the present embodiment.

(a) A Cr film of thickness 0.2 μm was formed using a sputter method on the silicon (Si) nozzle plate on which a nozzle was formed.

(b) Moreover, a gold film of thickness 0.5 μm was formed on the Cr film using a sputter method.

(c) C18H37SH was dissolved in ethyl alcohol to produce 1 mM solution.

(d) The nozzle plate on which gold layer was formed was immersed in the 1 mM ethyl alcohol solution in which C18H37SH was dissolved for 10 minutes at 25° C.

(e) The nozzle plate was then removed and rinsed with ethyl alcohol.

(f) The nozzle plate was then dried.

Ink Repellant Property

Contact angle with the ink was measured as an evaluation of the ink repellant property. Two types of ink, ink A and ink B, having different surface tensions were used for this evaluation. The surface tension of ink A was 35 dyn/cm and the surface escape force of ink B was 19 dyn/cm. The contact angle of ink A was found to be 90° and the contact angle of ink B was found to be 60°.

Adhesive Property

As an evaluation of adhesive properties, the nozzle plate surface was rubbed 5000 times with chloroprene rubber of rubber hardness 60° and with an additional load of 100 g/cm, after which the contact angles were measured. As a result, all the initial contact angles were preserved and no separated section was observed.

Anti-ink Property

As an evaluation of anti-ink properties, the nozzle plate on which thiol compound was formed was immersed in the ink for 6 days under ambient atmospheric pressure and a temperature of 60° C., after which the contact angle were measured. As a result, all the initial contact angles were preserved and no separated section was observed.

On Site Test

An ink jet printer head described in FIG. 10 was constructed using a nozzle plate on which thiol compounds was formed. The ink jet printer head was driven continuously 100,000 times with the response frequency of 10 KHz. As a result, all the ink drops were ejected in a normal direction and no abnormality such as bend in the ejection direction was found.

(3) Embodiment 3

In the present embodiment, an alloy film of NiCr was formed in place of intermediate layer with Cr in the embodiment 2.

(a) A NiCr film of thickness 0.2 μm was formed using a sputter method on the silicon (Si) nozzle plate on which a nozzle was formed.

(b) Moreover, a gold film of thickness 0.5 μm was formed on the NiCr film using a sputter method.

(c) C18H37SH was dissolved in ethyl alcohol to produce a 1 mM solution.

(d) The nozzle plate on which gold layer was formed was immersed in the 1 mM ethyl alcohol solution in which C18H37SH was dissolved for 10 minutes at 25° C.

(e) The nozzle plate was removed and rinsed with ethyl alcohol.

(f) The nozzle plate was then dried.

Ink Repellant Property

Contact angle with the ink was measured as an evaluation of the ink repellant properties. Two types of ink, ink A and ink B, having different surface tension were used for this evaluation. The surface tension of ink A was 35 dyn/cm and the surface tension of ink B was 19 dyn/cm. The contact angle of ink A was found to be 90° and the contact angle of ink B was found to be 60°.

Adhesive Property

As an evaluation of adhesive properties, the nozzle plate surface was rubbed 5000 times with chloroprene rubber of rubber hardness 60° and with an additional load of 100 g/cm, after which the contact angle was measured. As a result, all the initial contact angles were preserved and no separated section was observed.

Anti-ink Property

As an evaluation of anti-ink property, the nozzle plate on which thiol compound was formed was immersed in the ink for 6 days under ambient atmospheric pressure and at a temperature of 60° C., after which the contact angle was measured. As a result, all the initial contact angles were preserved and no separated section was observed.

On Site Test

An ink jet printer head described in FIG. 11 was constructed using a nozzle plate on which thiol compounds were formed. The ink jet printer head was driven continuously 100,000 times with the response frequency of 10 KHz. As a result, all the ink drops were ejected in a normal direction and no abnormality such as bend in the ejection direction was found.

(4) Embodiment 4

In the present embodiment, CnF2n+1—(n=12) is used as R in the thiol compound (R—SH).

(a) A gold film of thickness 0.5 μm was formed using a sputter method on the stainless steel nozzle plate on which a nozzle was formed.

(b) C12F25SH was dissolved in C8F18 to produce a 1 mM solution.

(c) The nozzle plate on which gold layer was formed was immersed in the 1 mM C8F18 solution in which C12F25SH was dissolved for 10 minutes at 25° C.

(d) The nozzle plate was then removed and rinsed with C8F18.

(e) The nozzle plate was then dried.

Ink Repellant Property

Contact angle with the ink was measured as an evaluation of the ink repellant properties. Two types of ink, ink A and ink B, having different surface tension were used for evaluation. The surface tension of ink A was 35 dyn/cm and the surface tension of ink B was 19 dyn/cm. The contact angle of ink A was found to be 110° and the contact angle of ink B was found to be 70°.

Adhesive Property

As an evaluation of adhesive property, the nozzle plate surface was rubbed 5000 times with chloroprene rubber of rubber hardness 60° and with additional load of 100 g/cm, after which the contact angle was measured. As a result, all the initial contact angles were preserved and no separated section was observed.

Anti-ink Property

As an evaluation of anti-ink properties, the nozzle plate on which thiol compound was formed was immersed in the ink for 6 days under ambient atmospheric pressure and at a temperature of 60° C., after which the contact angle was measured. As a result, all the initial contact angles were preserved and no separated section was observed.

On Site Test

An ink jet printer head described in FIG. 11 was constructed using a nozzle plate on which thiol compound was formed. The ink jet printer head was driven continuously 100,000 times with the response frequency of 10 KHz. As a result, all the ink drops were ejected in a normal direction and no abnormality such as bend in the ejection direction was found.

(5) Embodiment 5

In the present embodiment, CnF2n+1—CmH2m—(n=12, m=2) was used as R in the thiol compound (R—SH).

(a) A gold film of thickness 0.5 μm was formed using a sputter method on the stainless steel nozzle plate on which a nozzle was formed.

(b) C12F25-C2H4SH was dissolved in C8F18 to produce a 1 mM solution.

(c) The nozzle plate on which gold layer was formed was immersed in the 1 mM C8F18 solution in which C12F25-C2H4SH was dissolved for 10 minutes at 25° C.

(d) The nozzle plate was then removed and rinsed with C8F18.

(e) The nozzle plate was then dried.

Ink Repellant Property

Contact angle with the ink was measured as an evaluation of the ink repellant properties. Two types of ink, ink A and ink B, having different surface tension were used for evaluation. The surface tension of ink A was 35 dyn/cm and the surface tension of ink B was 19 dyn/cm. The contact angle of ink A was found to be 110° and the contact angle of ink B was found to be 70°.

Adhesive Property

As an evaluation of adhesive property, the nozzle plate surface was rubbed 5000 times with chloroprene rubber of rubber hardness 600 and with additional load of 100 g/cm, after which the contact angle was measured. As a result, all the initial contact angles were preserved and no separated section was observed.

Anti-ink Property

As an evaluation of anti-ink property, the nozzle plate on which thiol compound was formed was immersed in the ink for 6 days under ambient atmospheric pressure and at a temperature of 60° C., after which the contact angles were measured. As a result, all the initial contact angles were preserved and no separated section were observed.

On Site Test

An ink jet printer head described in FIG. 10 was constructed using a nozzle plate on which thiol compound was formed. The ink jet printer head was driven continuously 100,000 times with the response frequency of 10 KHz. As a result, all the ink drops were released in a normal direction and no abnormality such as bend in the ejection direction was found.

(6) Embodiment 6

In the present embodiment, CnF2n+1—CmH2m—(n=10, m=11) was used as R in the thiol compound (R—SH).

(a) A gold film of thickness 0.5 μm was formed using a sputter method on the stainless steel nozzle plate on which a nozzle was formed.

(b) Thiol compound (C10F21C11H22SH) was dissolved in ethyl alcohol to produce a 1 mM solution.

(c) The nozzle member on which gold layer was formed was immersed in the 1 mM ethyl alcohol solution in which thiol compound was dissolved for 10 minutes at 25° C.

(d) The nozzle member was then-removed and-rinsed with ethyl alcohol.

Ink Repellant Property

Contact angle with the ink was measured as an evaluation of the ink repellant properties. Two types of ink, ink A and ink B, having different surface tension were used for evaluation. The surface tension of ink A was 35 dyn/cm and the surface tension of ink B was 19 dyn/cm. The contact angle of ink A was found to be 90° and the contact angle of ink B was found to be 60°.

Adhesive Property

As an evaluation of adhesive property, the nozzle member surface was rubbed 5000 times with chloroprene rubber of rubber hardness 60° and with additional load of 100 g/cm, after which the contact angle was measured. As a result, all the initial contact angles were preserved and no separated section-was observed.

Anti-ink Property

As an evaluation of anti-ink property, the nozzle member on which thiol compound was formed was immersed in the ink for 10 days under ambient atmospheric pressure and a temperature of 60° C., after which the contact angle was measured. As a result, all the initial contact angles were preserved and no separated section was observed.

On Site Test

An ink jet printer head described in FIG. 10 was constructed using a nozzle plate on which thiol compound was formed. The ink jet printer head was driven continuously 100,000 times with the response frequency of 10 KHz. As a result, all the ink drops were ejected in a normal direction and no abnormality such as bend in the ejection direction was found.

(7) Embodiment 7

In the present embodiment, a mixture of two different types of thiol compounds was used to mold a nozzle plate.

(a) A Ni film of thickness 0.2 μm was formed using a sputter method on the silicon (Si) nozzle plate on which a nozzle was formed.

(b) Moreover, a gold film of thickness 0.5 μm was formed on the nozzle plate on which Ni film was formed using a sputter method.

(c) Equal moles of C10F21(CH2)11SH and C10F21SH were dissolved in dichloromethane to produce a 1 mM solution.

(d) The nozzle plate on which a gold layer was formed was immersed in the 1 mM dichloromethane solution in which a mixture of C10F21(CH2)11SH and C10F21SH was dissolved for 10 minutes at 25° C.

(e) The nozzle plate was then removed and rinsed with dichloromethane.

(f) The nozzle plate was then dried.

Ink Repellant Property

Contact angle with the ink was measured as an evaluation of the ink repellant property. Two types of ink, ink A and ink B, having different surface tension were used for evaluation. The surface tension of ink A was 35 dyn/cm and the surface tension of ink B was 19 dyn/cm. The contact angle of ink A was found to be 100° and the contact angle of ink B was found to be 70°.

Adhesive Property

As an evaluation of adhesive properties, the nozzle plate surface was rubbed 5000 times with chloroprene rubber of rubber hardness 60° and with an additional load of 100 g/cm, after which the contact angle was measured. As a result, all the initial contact angles were preserved and no separated section was observed.

Anti-ink property: As an evaluation of anti-ink properties, the nozzle plate on which thiol compound was formed was immersed in the ink for 6 days under ambient atmospheric pressure and a temperature of 60° C., after which the contact angle was measured. As a result, all the initial contact angles were preserved and no separated section was observed.

On Site Test

An ink jet printer head described in FIG. 10 was constructed using a nozzle plate on which thiol compound was formed. The ink jet printer head was driven continuously 100,000 times with the response frequency of 10 KHz. As a result, all the ink drops were ejected in a normal direction and no abnormality such as bend in the ejection direction was found.

(8) Embodiment 8

In the present embodiment, sulfur compounds having a formula HS—R—SH where R is expressed as

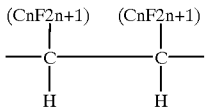

are formed on the nozzle plate (n=10).

(a) A Cr film of thickness 0.2 μm was formed using a sputter method on the silicon (Si) nozzle plate on which a nozzle was formed.

(b) Moreover, a gold film of thickness 0.5. μm was formed on the Cr film using a sputter method.

(c)

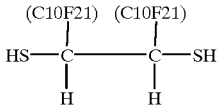

(hereafter molecule A) was dissolved in chloroform to produce a 1 mM solution.

(d) The nozzle plate on which gold layer was formed was immersed in the 1 mM chloroform solution in which molecule A was dissolved for 10 minutes at 25° C.

(e) The nozzle plate was then removed and rinsed with chloroform.

(f) The nozzle plate was then dried.

Ink repellant property

Contact angle with the ink was measured as an evaluation of the ink repellant properties. Two types of ink, ink A and ink B, having different surface tension were used for evaluation. The surface tension of ink A was 35 dyn/cm and the surface escape force of ink B was 19 dyn/cm. The contact angle of ink A was found to be 110° and the contact angle of ink B was found to be 70°.

Adhesive Property

As an evaluation of adhesive property, the nozzle plate surface was rubbed 5000 times with chloroprene rubber of rubber hardness 60° and with additional load of 100 g/cm, after which the contact angle was measured. As a result, all the initial contact angles was preserved and no separated section was observed.

Anti-ink Property

As an evaluation of anti-ink properties, the nozzle plate on which thiol compound was formed was immersed in the ink for 6 days under ambient atmospheric pressure and a temperature of 60° C., after which the contact angle was measured. As a result, all the initial contact angles were are preserved and no separated section was observed.

On Site Test

An ink jet printer head described in FIG. 11 was constructed using a nozzle plate on which thiol compound was formed. The ink jet printer head was driven continuously 100,000 times with the response frequency of 10 KHz. As a result, all the ink drops were ejected in a normal direction and no abnormality such as bend in the ejection direction was found.

(9) Embodiment 9

In the present embodiment, sulfur compounds having a formula HS—R—SH where R is expressed as

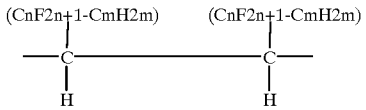

was formed on the nozzle plate (n=10, m=11).

(a) A gold film of thickness 0.5 μm was formed on the stainless steel nozzle plate, on which a nozzle was formed, using a sputter method.

(b)

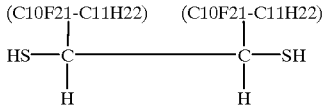

(hereafter molecule B) was dissolved in chloroform to produce a 1 mM solution.

(c) The nozzle plate on which gold layer was formed was immersed in the 1 mM chloroform solution in which molecule B was dissolved for 10 minutes at 25° C.

(d) The nozzle plate was then removed and rinsed with chloroform.

(e) The nozzle plate was then dried.

Ink Repellant Property

Contact angle with the ink was measured as an evaluation of the ink repellant properties. Two types of ink, ink A and ink B, having different surface tension were used for evaluation. The surface tension of ink A was 35 dyn/cm and the surface tension of ink B was 19 dyn/cm. The contact angle of ink A was found to be 110° and the contact angle of ink B was found to be 70°.

Adhesive Property

As an evaluation of adhesive properties, the nozzle plate surface was rubbed 5000 times with chloroprene rubber of rubber hardness 60° and with additional load of 100 g/cm, after which the contact angle was measured. As a result, all the initial contact angles were preserved and no separated section was observed.

Anti-ink Property

As an evaluation of anti-ink properties, the nozzle plate on which thiol compound was formed was immersed in the ink for 6 days under ambient atmospheric pressure and a temperature of 60° C., after which the contact angle was measured. As a result, all the initial contact angles were preserved and no separated section was observed.

On Site Test

An ink jet printer head described in FIG. 11 was constructed using a nozzle plate on which thiol compound was formed. The ink jet printer head was driven continuously 100,000 times with the response frequency of 10 KHz. As a result, all the ink drops were ejected in a normal direction and no abnormality such as bend in the ejection direction was found.

(10) Embodiment 10

In the present embodiment, sulfur compounds having a formula HS—R—SH where R is expressed as

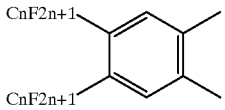

were formed on the nozzle plate (n=10, m=11).

(a) A gold film of thickness 0.5 μm was formed on the stainless steel nozzle plate, on which a nozzle was formed, using a sputter method.

(b) Molecule with formula

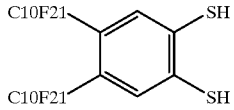

(hereafter molecule C) was dissolved in C8F18 to produce a 1 mM solution.

(c) The nozzle plate on which gold layer was formed was immersed in the 1 mM C8F18 solution in which molecule C was dissolved for 10 minutes at 25° C.

(d) The nozzle plate was then removed and rinsed with C8F18.

(e) The nozzle plate was then dried.

Ink Repellant Property

Contact angle with the ink was measured as an evaluation of the ink repellant properties. Two types of ink, ink A and ink B, having different surface tension were used for evaluation. The surface tension of ink A was 35 dyn/cm and the surface tension of ink B was 19 dyn/cm. The contact angle of ink A was found to be 1000 and the contact angle of ink B was found to be 70°.

Adhesive Property

As an evaluation of adhesive properties, the nozzle plate surface was rubbed 5000 times with chloroprene rubber of rubber hardness 60° and with additional load of 100 g/cm, after which the contact angle was measured. As a result, all the initial contact angles were preserved and no separated section was observed.

Anti-ink Property

As an evaluation of anti-ink properties, the nozzle plate on which thiol compound was formed was immersed in the ink for 6 days under ambient atmospheric pressure and a temperature of 60° C., after which the contact angle was measured. As a result, all the initial contact angles were preserved and no separated section was observed.

On Site Test

An ink jet printer head described in FIG. 11 was constructed using a nozzle plate on which thiol compound was formed. The ink jet printer head was driven continuously 100,000 times with the response frequency of 10 KHz. As a result, all the ink drops are ejected in a normal direction and no abnormality such as bend in the ejection direction was found.

(11) Embodiment 11

In the present embodiment, sulfur compounds having a formula HS—R—SH where R is expressed as

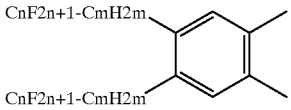

are formed on the nozzle plate (n=10, m=11).

(a) A NiCr film of thickness 0.5 μm was formed on the stainless steel nozzle plate, on which a nozzle was formed, using a sputter method.

(b) Moreover, a gold film of thickness 0.5 μm was formed on the NiCr film using sputter method.

(c) Molecule with formula

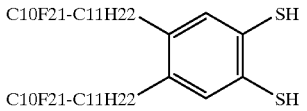

(hereafter molecule D) was dissolved in chloroform/ethyl alcohol mixture solution (70/30 vol %) to produce a 1 mM solution.

(d) The nozzle plate on which gold layer was formed was immersed in the 1 mM chloroform/ethyl alcohol mixture solution in which molecule D was dissolved for 10 minutes at 25° C.

(e) The nozzle plate was then removed and rinsed with chloroform.

(f) The nozzle plate was then dried.

Ink Repellant Property

Contact angle with the ink was measured as an evaluation of the ink repellant property. Two types of ink, ink A and ink B, having different surface tension were used for evaluation. The surface tension of ink A was 35 dyn/cm and the surface tension of ink B was 19 dyn/cm. The contact angle of ink A was found to be 105° and the contact angle of ink B was found to be 70°.

Adhesive Property

As an evaluation of adhesive property, the nozzle plate surface was rubbed 5000 times with chloroprene rubber of rubber hardness 60° and with additional load of 100 g/cm, after which the contact angle was measured. As a result, all the initial contact angles were preserved and no separated section-was observed.

Anti-ink Property

As an evaluation of anti-ink properties, the nozzle plate on which thiol compound was formed was immersed in the ink for 6 days under ambient atmospheric pressure and a temperature of 60° C., after which the contact angle was measured. As a result, all the initial contact angles were preserved and no separated section was observed.

On Site Test

An ink jet printer head described in FIG. 11 was constructed using a nozzle plate on which thiol compound was formed. The ink jet printer head was driven continuously 100,000 times with the response frequency of 10 KHz. As a result, all the ink drops were ejected in a normal direction and no abnormality such as bend in the ejection direction was found.

(12) Embodiment 12

In the present embodiment, sulfur compounds having a formula R—S—S—R where R is expressed as were formed on the nozzle plate (n=10, m=11).

(a) A Cr film of thickness 0.2 cm was formed on the stainless steel nozzle plate, on which a nozzle was formed, using a sputter method.

(b) Moreover, a gold film of thickness 0.5 μm was formed on the Cr film using sputter method.

(c) C10F21-C11H22-S-S-C11H22-C10F21 was dissolved in dichloromethane to produce a 1 mM solution.

(d) The nozzle plate on which gold layer was formed was immersed in the 1 mM dichloromethane solution in which C10F21-C11H22-S-S-C11H22-C10F21 was dissolved for 10 minutes at 25° C.

(e) The nozzle plate was then removed and rinsed with dichloromethane.

(f) The nozzle plate was then dried.

Ink Repellant Property

Contact angle with the ink was measured as an evaluation of the ink repellant properties. Two types of ink, ink A and ink B, having different surface tension were used for evaluation. The surface tension of ink A was 35 dyn/cm and the surface escape force of ink B was 19 dyn/cm. The contact angle of ink A was found to be 110° and the contact angle of ink B was found to be 60°.

Adhesive Property

As an evaluation of adhesive properties, the nozzle plate surface was rubbed 5000 times with chloroprene rubber of rubber hardness 60° and with additional load of 100 g/cm, after which the contact angle was measured. As a result, all the initial contact angles were preserved and no separated section was observed.

(13) Embodiment 13

In the present embodiment, sulfur compounds having a formula R—S—S—R where R is expressed as CnF2n+1— were formed on the nozzle plate (n=10).

(a) A Cr film of thickness 0.2 μm was formed on the stainless steel nozzle plate, on which a nozzle was formed, using a sputter method.

(b) Moreover, a gold film of thickness 0.5 μm was formed on the Cr film using sputter method.

(c) C10F21-S-S-C10F21 was dissolved in chloroform to produce a 1 mM solution.

(d) The nozzle plate on which a gold layer was formed was immersed in the 1 mM chloroform solution in which C10F21-S-S-C10F21 was dissolved for 10 minutes at 25° C.

(e) The nozzle plate was then removed and rinsed with chloroform.

(f) The nozzle plate was then dried.

Ink Repellant Property

Contact angle with the ink was measured as an evaluation of the ink repellant properties. Two types of ink, ink A and ink B, having different surface tension were used for evaluation. The surface tension of ink A was 35 dyn/cm and the surface tension of ink B was 19 dyn/cm. The contact angle of ink A was found to be 100° and the contact angle of ink B was found to be 60°.

Adhesive Property

As an evaluation of adhesive property, the nozzle plate surface was rubbed 5000 times with chloroprene rubber of rubber hardness 60° and with additional load of 10 g/cm, after which the contact angles was measured. As a result, all the initial contact angles were preserved and no separated section was observed.

Anti-ink Property

As an evaluation of anti-ink property, the nozzle plate on which thiol compound was formed was immersed in the ink for 6 days under ambient atmospheric pressure at a temperature of 60° C., after which the contact angle was measured. As a result, all the initial contact angles were preserved and no separated section was observed.

On Site Test

An ink jet printer head described in FIG. 11 was constructed using a nozzle plate on which thiol compound was formed. The ink jet printer head was driven continuously 100,000 times with the response frequency of 10 KHz. As a result, all the ink drops were ejected in a normal direction and no abnormality such as bend in the ejection direction was found.

As described above, in the configuration 1 of the present embodiment, by forming a metal layer on the nozzle surface and by forming sulfur compounds additionally on the metal layer, an ink jet printer head with high level of ink repellant properties and high level of anti-wear properties may be produced.

Configuration of the Second Embodiment

In the configuration of embodiment 2 of the present invention, being different from the aforementioned configuration of embodiment 1, a ink repellant layer was formed to the inner wall of the nozzle.

Figure 12:
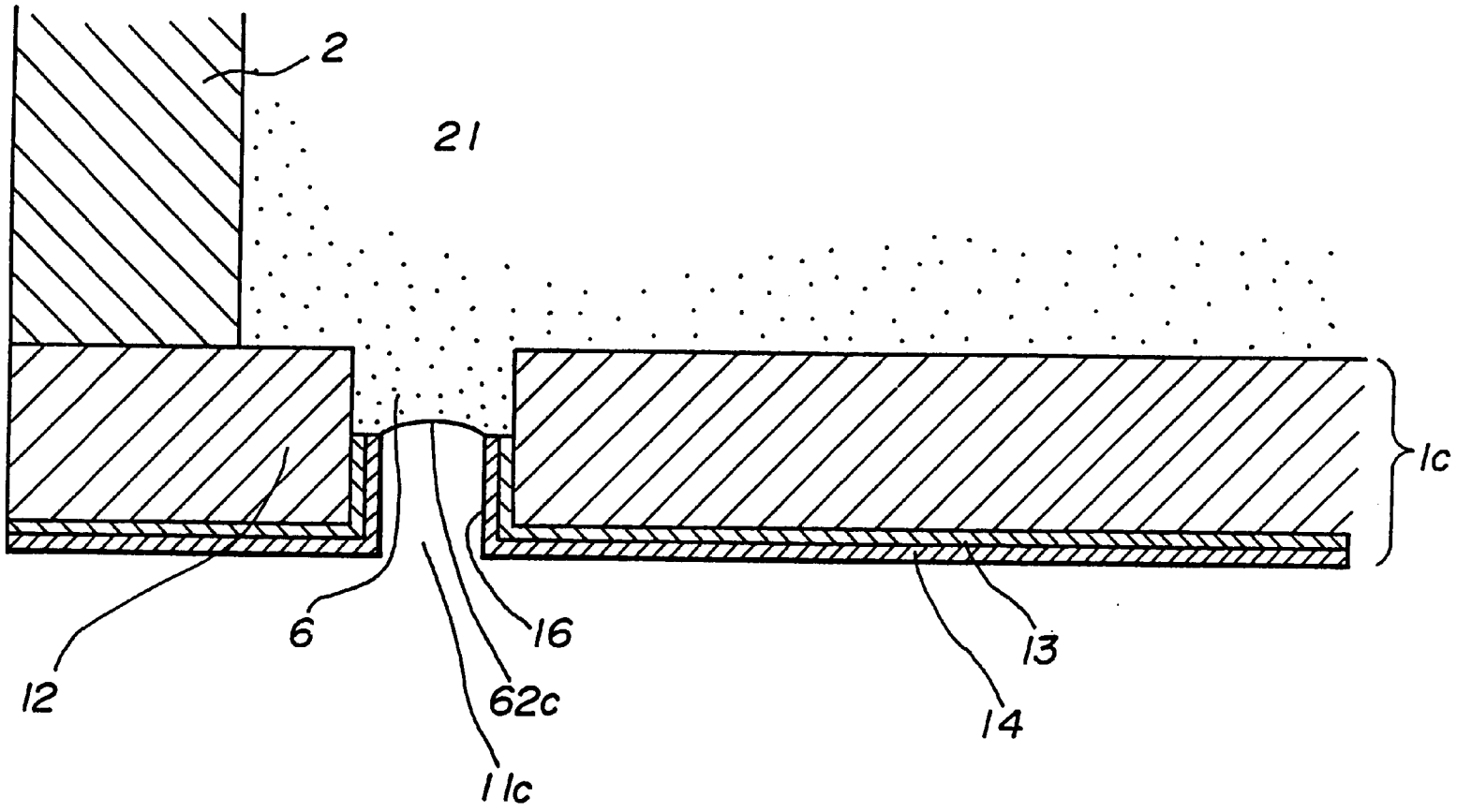
FIG. 12: A cross section of a nozzle plate for which an ink repellant layer is provided in the nozzle in a second embodiment.

FIG. 12 describes an enlarged cross section of vicinity of the nozzle in the nozzle plate of the configuration of embodiment 2. The members that are same as the ones in the aforementioned configuration of embodiment 1 (FIG. 5) are identified by the same symbols and the explanation was omitted. As shown in FIG. 12, in the nozzle plate 1*c* of the present embodiment, the metal layer 13 and the sulfur compound layer 14 are formed onto the inner wall of the nozzle 11*c*. Hence, the position where meniscus 62C of ink 6 was formed is moved closer to the cavity 21, due to ink repellant properties of sulfur compound layer 14, than in the case described in FIG. 5.

Incidently, composition of the metal layer and sulfur compound layer can be considered same as the aforementioned configuration of embodiment 1. Moreover, an ink repellant film is made of the metal layer and the sulfur compound layer in FIG. 12, but an ink repellant film with an intermediate layer being provided between the nozzle member and the metal layer, which is shown in FIG. 11, may be provided.

In the configuration of embodiment 2, anti-wear properties and anti-impact properties, which are strong against mechanical impact, may be achieved because the sulfur compound layer 14 with ink repellant property is formed inside the nozzle 14. In particular, the configuration of element 2 is extremely effective for usage such as dying of industrial-use textiles and industrial printing which cause scratches on the surface of the nozzle member 12. When a sharp object makes contact with the surface of the nozzle section of the nozzle member, which causes scratches around the nozzle, the ink repellant film normally is damaged around the point of contact. Hence, the shape of the meniscus of the ink changes resulting in deterioration of ink ejecting capability. On the other hand, if the inner wall 16 which is composed of the ink repellant film is formed inside the nozzle 11*c* as in the case of the configuration of the present embodiment, the meniscus 62*c* of the ink forms inside the nozzle. Hence, scratches on the surface do not cause change in the meniscus 62*c* of the ink and the ink ejection capability does not deteriorate.

Next, a preferred embodiment of a manufacturing method of ink jet printer head in the configuration of the present embodiment will be described.

Embodiment (a) A gold film of thickness 0.5 $\mu$m was formed using a sputter method on the stainless steel nozzle member of thickness 80 $\mu$m on which a nozzle was formed. In this case, sputtering was performed by arranging the nozzle member in a slanted position with respect to the target. By this a gold film was formed to the position that is 30 $\mu$m deep inside the nozzle (corresponds to the inner wall 16 of FIG. 12).

(b) Thiol compound (C10F21C11H22SH) was dissolved in ethyl alcohol to produce a 1 mM solution.

(c) The nozzle member on which gold layer was formed was placed in ink and was immersed in the 1 mM ethyl alcohol solution in which thiol compound was dissolved for 10 minutes at 25° C.

(d) The nozzle member was removed and rinsed with ethyl alcohol.

Ink Repellant Property

Contact angle with the ink was measured as an evaluation of the ink repellant properties. Two types of ink, ink A and ink B, having different surface tension were used for evaluation. The surface tension of ink A was 35 dyn/cm and the surface tension of ink B was 19 dyn/cm. The contact angle of ink A was found to be 90° and the contact angle of ink B was found to be 60°.

Adhesive Property

As an evaluation of adhesive property, the nozzle member surface was rubbed 5000 times with chloroprene rubber of rubber hardness 60° and with additional load of 100 g/cm, after which the contact angle was measured. As a result, all the initial contact angles were preserved and no separated section was observed. Moreover, the nozzle surface was rubbed 1000 times with #500 sand paper with a load of 100 g/cm. The gold film on the surface of the nozzle member was lost and the contact angle with ink was 10° or less. Existence of gold film was confirmed by observation of inside of the nozzle through a microscope.

On Site Test

An ink jet printer head described in FIG. 10 was constructed using a nozzle member which was rubbed with #500 sand paper. The ink jet printer head was driven continuously 100,000 times with the response frequency of 10 KHz. As a result, all the ink drops were ejected in a normal direction and no abnormality such as bend in the ejection direction was found.

As described above, in the configuration of embodiment 2, extremely strong ink repellant treatment against mechanical impact was achieved. (Configuration of embodiment 3)

The configuration of embodiment 3 relates to improvement of the nozzle.

Figure 13:
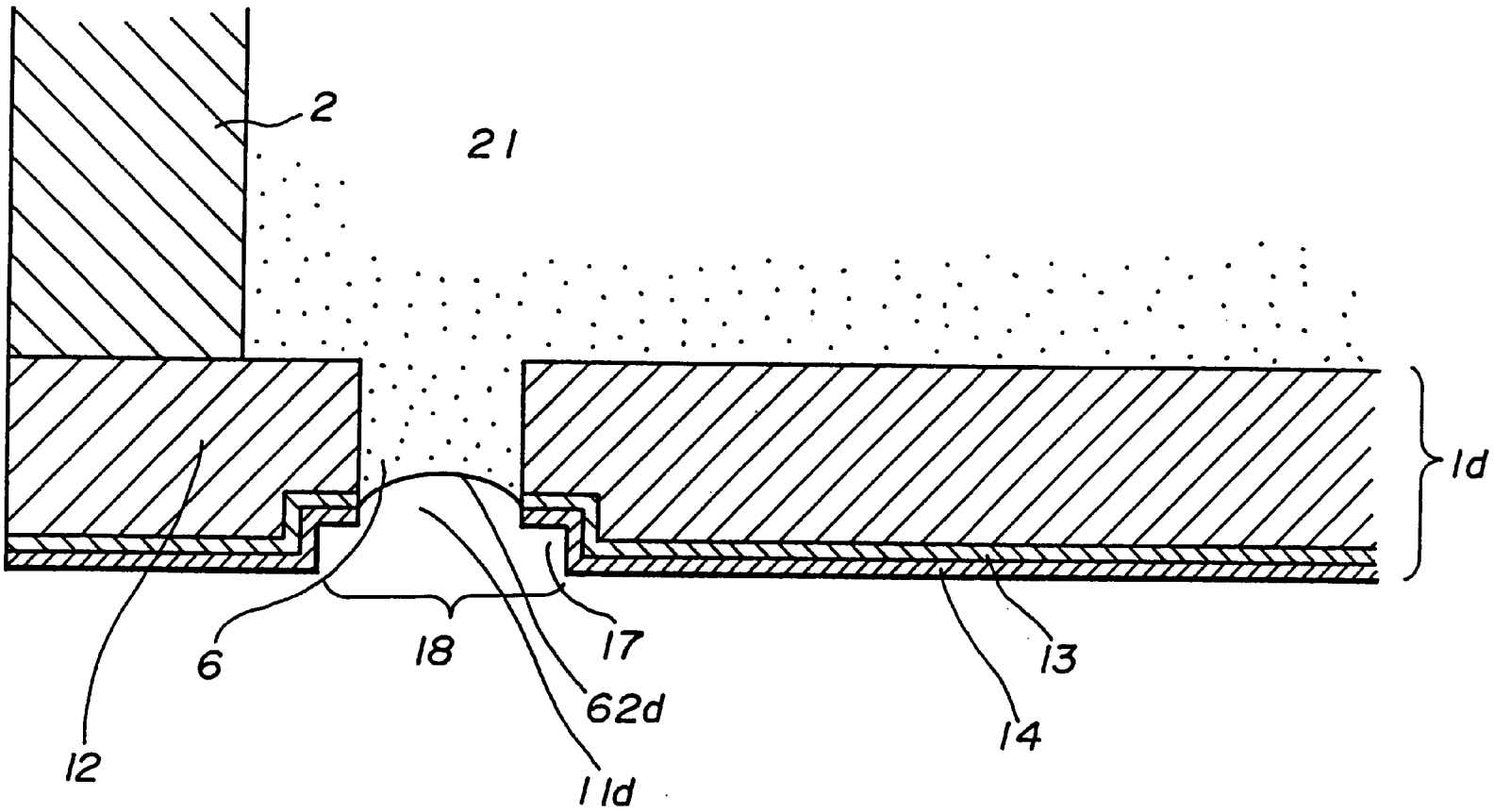
FIG. 13: A cross section of a nozzle plate for which a step is provided in the nozzle for the third embodiment.

FIG. 13 describes an enlarged cross section of the vicinity of the nozzle in the nozzle plate of the configuration of embodiment 3 . The members that are same as the ones in the aforementioned configuration of embodiment 1 (FIG. 5) are identified by the same symbols and the explanation is omitted.

As described in FIG. 13, a step section 17 is provided in the vicinity of the nozzle lid of the nozzle plate 1*d* of the present configuration. Moreover, an indented section 18 is formed concentrically with the nozzle lid. An ink repellant film made of the metal layer 13 and the sulfur compound layer 14 is also formed inside the step section 17 and the indented section 18.

Incidently, composition of the metal layer and sulfur compound layer can be considered same as the aforementioned configuration of embodiment 1. Moreover, an ink repellant film is made of the metal layer and the sulfur compound layer in FIG. 13, but an ink repellant film with an intermediate layer being provided between the nozzle member and the metal layer, which is shown in FIG. 11, may be provided (see the embodiment).

In the configuration of embodiment 3 , by providing the step section 17 and the indentation section 18 in the nozzle lid, the metal layer 13 and the sulfur compound layer 14 in the indentation section 18 does not receive damage even when a sharp object makes contact with the surface of the nozzle plate 1*d*. Hence meniscus 62*d* of ink 6 does not change and the ejection capability of ink does not deteriorate.

(a) A Cr film of thickness 0.5 $\mu$m was formed on a silicon (Si) nozzle member and on a zirconia ceramics nozzle member on which a nozzle was formed, using a sputter method.

(b) Moreover, a gold film of thickness 0.5 $\mu$m was formed on the Cr film, using a sputter method.

(c) Thiol compound (C10F21C11H22SH) was dissolved in ethyl alcohol to produce a 1 mM solution.

(d) The nozzle member on which gold layer was formed was placed in ink and was immersed in the 1 mM ethyl alcohol solution in which thiol compound was dissolved for 10 minutes at 25° C.

(e) The nozzle member was then removed and rinsed with ethyl alcohol.

Ink Repellant Property

Contact angle with the ink was measured as an evaluation of the ink repellant property. Two types of ink, ink A and ink B, having different surface tension were used for evaluation. The surface tension of ink A was 35 dyn/cm and the surface tension of ink B was 19 dyn/cm. The contact angle of ink A was found to be 90° and the contact angle of ink B was found to be 60°.

Adhesive Property

As an evaluation of adhesive properties, the nozzle member surface was rubbed 5000 times with chloroprene rubber of rubber hardness 60° and with additional load of 100 g/cm, after which the contact angle was measured. As a result, all the initial contact angles were preserved and no separated section was observed.

Anti-ink Property

As an evaluation of anti-ink property, the nozzle plate on which thiol compound was formed was immersed in the ink for 6 days under ambient atmospheric pressure and a temperature of 60° C., after which the contact angle was measured. As a result, all the initial contact angles were preserved and no separated section was observed.

On Site Test

An ink jet printer head described in FIG. 10 was constructed using a nozzle member which was rubbed with #500 sand paper. The ink jet printer head was driven continuously 100,000 times with the response frequency of 10 KHz. As a result, all the ink drops were ejected in a normal direction and no abnormality such as bend in the ejection direction was found.

Configuration of Embodiment 4

Figure 14:
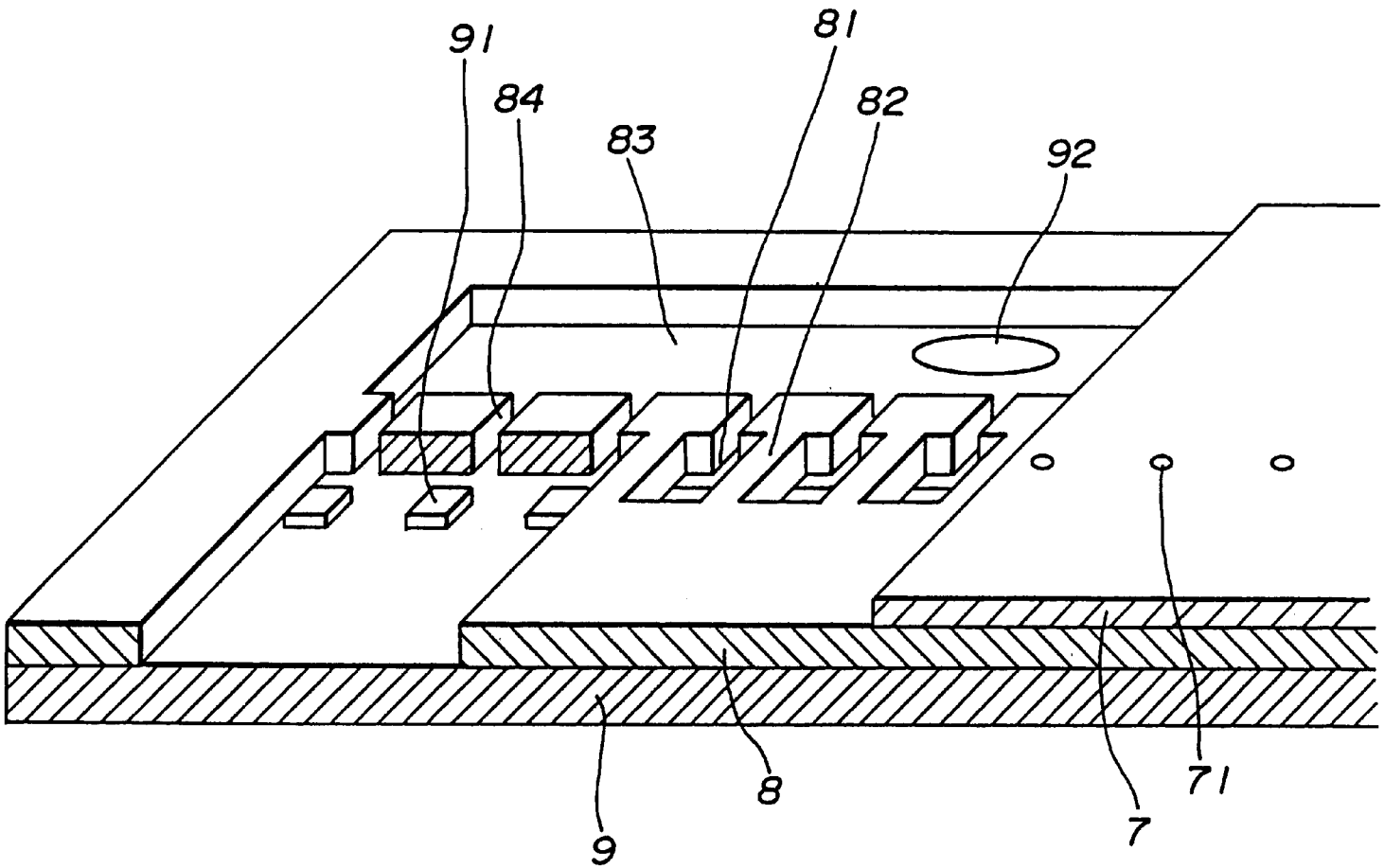
FIG. 14: An perspective view of an ink printer head which uses a heat generating element in the fourth embodiment.

An example of an ink jet printer head which operates by means of a heat generating element is described. FIG. 14 is a perspective view describing a structure of the ink jet printer head of the configuration of the present embodiment. The ink jet printer head is mainly composed of a nozzle plate 7, a flow path board 8 and a heat generating element board 9.

A nozzle 71 is provided on the nozzle plate 7. The metal layer 13, the sulfur compound layer 14 and the intermediate layer 15 which are described in the configuration of embodiment 1, the inner wall inside the nozzle which is described in the configuration of embodiment 2, and the step section 17 and the indented section 18 which are described in the configuration of embodiment 3 may be applied to the nozzle plate 7.

A cavity 81, a side wall 82, a reservoir 83 and a supply path are formed on the flow path board 8. These structures may be considered same as the structures of the flow path board 2 which are described in the aforementioned configuration of embodiment 1. The plurality of cavities 81 are arranged with specific interval corresponding to print density. Each cavity 81 is divided by the side wall 82. The cavity 81 is pinched between the side wall of the flow path board 8, the nozzle plate 7 and the heat generating element board 9.

An heat generating element 91 is provided on the heat generating element board 9 at the location corresponding to each cavity 81. Moreover, an ink tank opening 92 is provided for supplying ink to the reservoir 83.

In the above structure, ink is introduced from ink tank (not shown) to the reservoir 83 through the ink tank opening 92. Ink in the reservoir 83 is supplied to the cavity 81 through the supply opening 84. When electric signals are supplied to the heat generating element 91 through driving circuit (not shown) the heat generating element 91 generates heat. As a result, ink which is filled in the cavity of the heat generating element 91 which is generating heat is vaporized and air bubbles are generated. These air bobbles cause ink to be ejected from the nozzle 71 which is provided corresponding to the cavity 81. At this time, the ejecting side of the nozzle plate 7 displays ink repellant properties because of the structure described in configuration of embodiments 1–3. Hence, no ink remains on the nozzle surface which pulls the ejecting ink in the direction parallel to the nozzle surface resulting in the ejection direction to be bent.

As described above, the configuration of embodiment 4 demonstrates that the present invention may be applied to the ink jet printer head in which air bubbles are generated by the heat generating elements to eject ink. Similar effects, as ones described in configurations of embodiment 1–3, are obtained.

Configuration of Embodiment 5

In the configuration of embodiment 5 of the present invention, wetting properties of the surface which is formed by a molecular film of the sulfur compound layer and which possesses ink repellant function is evaluated by the size of the contact angle of the liquid drops.

Table 1 describes measurement results of the contact angle between water and ink, anti-wear properties and stability of ink scattering of the ink jet printer head which uses thiol compounds as sulfur compounds. Moreover, in order to compare the properties of the ink jet printer head of the present invention against the properties of ink jet printer head without sulfur compounds, properties obtained when nozzle surfaces are made of gold and stainless steel are also described.

| Embodiment Number | Thiol Compound | Contact -Angle (Water) | Contact -Angle (Ink) | Anti-Wear Properties | Ink-Scattering Stability |
|---|---|---|---|---|---|
| 1 | CF3(CF2)9(CH2)11SH | 120 | 72 | ○ | ○ |
| 2 | CF3(CF2)7(CH2)6SH | 118 | 70 | ○ | ○ |
| 3 | CF3(CF2)9(CH2)2SH | 115 | 64 | ○ | ○ |
| 4 | CH3(CH2)17SH | 103 | 60 | ○ | ○ |
| 5 | {CF3(CF2)9(CH2)22}2 = SS | 120 | 74 | ○ | ○ |
| 6 | {CF3(CF2)7(CH2)6}2 = SS | 116 | 70 | | |
| Comparative Embodiment | Gold (Au) Surface only | 50 | 16 | x | x |

-continued

| Embodiment Number | Thiol Compound | Contact -Angle (Water) | Contact -Angle (Ink) | Anti-Wear Properties | Ink-Scattering Stability |
|---|---|---|---|---|---|
| Comparative Embodiment 2 | Stainless-Steel surface only | 35 | 15 | x | x |

Thiol compounds of each example in Table 1 were produced by the following method.

(a) A thin gold film of thickness 200 nm was formed on the stainless steel board using a sputter method.

(b) Thiol compounds with each component described in Table 1, 0.1 mM each, were immersed for about one hour in the disulfide ethanol solution.

(c) After immersion, the board was then washed with ethanol and dried at room temperature.

Measurement

1. Contact Angle

Distilled water drops and ink drops were placed on each surface and the static contact angles were measured at the room temperature. For the contact angle measurement instrument, CA-D made by Kyowa Kaimen Kagaku was used. Moreover, ink used in the measurement was composed of distilled water, ethylene glycol, dye, distribution agent and pH adjustment agent. The viscosity was about 6 cps.

2. Anti-wear Property

The surface of the nozzle plate on which molecule film was formed was rubbed 5000 times with chloroprene rubber of rubber hardness 60° and is with additional load of 100 g/cm, after which the wetting condition of the surface with respect to the ink drops was measured. The wetting condition was determined by (i) immersing each board which was rubbed in ink solution followed by airing the board at room temperature for five minutes and (ii) by raising the board which was aired to determine whether the ink was smeared on the surface or whether ink repellant properties were maintained.

3. Ink Scattering Stability

An ink jet printer head using a nozzle plate on which thiol compound layer was formed was produced. From the nozzle of the head produced, about one billion ink dots were continuously sprayed. Dot condition of print patterns being formed by ink spray was examined. Measurement was conducted by continuously monitoring whether ink drops were bent during flying, or whether deterioration in spray stability was found due to generation of satellite and the like.

The configuration of embodiment 5 enables regulation of ink repellant properties of sulfur compound by adjusting contact angle to water. Use of sulfur compounds which have a contact angle with water of no less than 100° results in excellent performance.

As described in each configuration of the embodiments, the ink jet printer head and its production method of the present invention enables formation of ink repellant sulfur compounds, which prevent ink from remaining on the nozzle surface. Hence, problems such as ink being pulled by the residue ink which remains on the surface, causing bend in ink drop ejection direction, are eliminated.

Moreover, by forming an ink repellant layer in the inner wall of the nozzle or by providing an indented section around the nozzle, the ink jet printer head becomes stronger against wear and is able to maintain ink repellant properties.

Furthermore, by mixing sulfur compounds with ink, self repair function against pealing of the sulfur compound layer is achieved.

What is claimed is:

1. An ink jet printer head for ejecting ink comprising:

a nozzle plate;

one or more nozzles in said nozzle plate; and a water repellant layer on said nozzle plate, wherein said water repellant layer comprises a metal layer containing at least one metal on said nozzle plate and a sulfur compound layer containing at least one sulfur compound on said metal layer.

2. The ink jet printer head of claim 1 further comprising:

an intermediate layer comprising at least one metal selected from the group consisting of nickel, chromium, tantalum, titanium and mixtures thereof, wherein said intermediate layer is disposed between said nozzle plate and said metal layer.

3. The ink jet printer head of claim 1, wherein said one or more nozzles have at least one inner wall and said water repellent layer is formed on said at least one inner wall.

4. The ink jet printer head of claim 1, wherein said one or more nozzles has at least one vertical inner wall and at least one horizontal inner wall forming an indented nozzle.

5. The ink jet printer head of claim 4, wherein said indented nozzle forms at least one step.

6. The ink jet printer head of claim 1 further comprising:

a cavity for filling said ink; and a pressure apparatus for causing a volume change in said cavity, said volume change of said cavity being sufficient to eject said ink as drops out of said one of more nozzles.

7. The ink jet printer head of claim 6, wherein said pressure apparatus comprises a piezoelectric element.

8. The ink jet printer head of claim 6, wherein said pressure apparatus comprises a heat-generating element.

9. The ink jet printer head of claim 1, wherein said at least one sulfur compound is a thiol compound.

10. The ink jet printer head of claim 9, wherein said thiol compound has the structure:

$$R—SH,$$

wherein R is a hydrocarbon radical.

11. The ink jet printer head of claim 10, wherein R has the structure:

$$C_nH_{2n+1}—$$

wherein n is an integer.

12. The ink jet printer head of claim 10, wherein R has the structure:

$$C_nF_{2n+1}—$$

wherein n is an integer.

13. The ink jet printer head of claim 10, wherein R has the structure:

$$C_nF_{2n+1}—C_mH_{2m}—$$

wherein n and m are each integers.

14. An ink jet printer head of claim 1, wherein said at least one sulfur compound comprises a mixture of compounds having the structures:

$$R^1—SH \text{ and } R^2—SH,$$

wherein $R^1$ and $R^2$ are independently mutually exclusive halocarbon radicals, hydrocarbon radicals or mixtures thereof.

15. The ink jet printer head of claim 14, wherein $R^1$ and $R^2$ independently have the structure:

$$C_nF_{2n+1}—$$

wherein n is an integer.

16. The ink jet printer head of claim 14, wherein $R^1$ and $R^2$ independently have the structure:

$$C_nF_{2n+1}—C_mH_{2m}—.$$

17. An ink jet printer head of claim 1, wherein said at least one sulfur compound has the structure:

$$HS—R^3—SH,$$

wherein $R^3$ is a halocarbon radical, a hydrocarbon radical or mixtures thereof.

18. The ink jet printer head of claim 17, wherein $R^3$ has the structure:

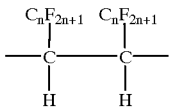

wherein n is an integer.

19. The ink jet printer head of claim 17, wherein $R^3$ has the structure:

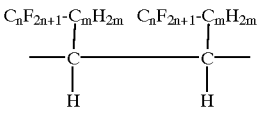

wherein n and m are integers.

20. The ink jet printer head of claim 17, wherein $R^3$ has the structure:

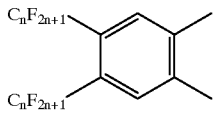

wherein n is an integer.

21. The ink jet printer head of claim 17, wherein $R^3$ has the structure:

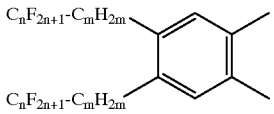

wherein n and m are integers.

22. An ink jet printer head of claim 1, wherein said at least one sulfur compound comprises the structure:

$$R^4—S—S—R^4,$$

wherein $R^4$ is a halocarbon radical, a hydrocarbon radical or mixtures thereof.

23. The ink jet printer of claim 22, wherein $R^4$ has a structure selected from the group consisting of $$C_nF_{2n+1}—C_mH_{2m}—,$$

$$C_nF_{2n+1}—$$

and mixtures thereof, wherein n and m are integers.

24. The ink jet printer head of claim 1, wherein said nozzle plate is made of silicon, ceramic or mixtures thereof.

25. An ink for use in the ink jet printer head of claim 1, wherein said ink comprises at least one sulfur compound.

26. The ink jet printer head of claim 1, wherein said sulfur compound layer has a water contact angle of more than about 100°.

27. A process for producing an ink jet printer head having a nozzle plate comprising the steps of:

forming a metal layer on said nozzle plate having one or more nozzles; and then immersing said nozzle plate having said metal layer thereon in a solution of at least one sulfur compound to form a sulfur compound layer.

* * * * *